United States Patent [19]

Hirano et al.

[11] Patent Number: 5,035,993

[45] Date of Patent: Jul. 30, 1991

[54] SILVER HALIDE PHOTOGRAPHIC MATERIAL

[75] Inventors: Shigeo Hirano; Ashita Murai; Seiji Suzuki, all of Kanagawa, Japan

[73] Assignee: Fuji Photo Film Co., Ltd., Kanagawa, Japan

[21] Appl. No.: 474,243

[22] Filed: Feb. 5, 1990

Related U.S. Application Data

[63] Continuation of Ser. No. 59,946, Jun. 9, 1987, abandoned.

[30] Foreign Application Priority Data

Jun. 10, 1986 [JP] Japan ..... 61-134513

[51] Int. Cl.[5] ..... G03C 1/035; G03C 1/485

[52] U.S. Cl. ..... 430/598; 430/567; 430/600

[58] Field of Search ..... 430/598, 600, 567

[56] References Cited

U.S. PATENT DOCUMENTS

| | | | |
|---|---|---|---|
| 3,730,723 | 5/1973 | Gilman et al. | 430/598 |
| 3,734,738 | 5/1973 | Kurtz et al. | 430/598 |
| 3,759,901 | 9/1973 | Lincoln et al. | 430/598 |
| 4,115,122 | 9/1978 | Adachi et al. | 430/598 |
| 4,471,044 | 9/1984 | Parton et al. | 430/598 |

*Primary Examiner*—Charles L. Bowers, Jr.
*Assistant Examiner*—Mark R. Buscher
*Attorney, Agent, or Firm*—Burns, Doane, Swecker & Mathis

[57] ABSTRACT

A silver halide photographic material, which comprises a support having provided thereon at least one light-sensitive silver halide emulsion layer, the silver halide emulsion layer or at least one other hydrophilic colloid layer of the material containing at least one heterocyclic quaternary ammonium salt compound represented by the following general formula (I):

(I)

wherein Z represents non-metallic atoms necessary for forming a 5- or 6-membered heterocyclic ring which may be substituted with a substituted group; $R^1$ represents an aliphatic group; $R^2$ represents a hydrogen atom, an aliphatic group, or an aromatic group; Y represents a charge-balancing counter ion; and n is 0 or 1; provided that at least one of $R^1$, $R^2$, and Z has an acyl group, a hydrazine group, or a hydrazone group, or $R^1$ and $R^2$ form a 6-membered dihydropyridinium skeleton, and at least one of $R^1$, $R^2$, and Z includes the group $-X-(L)_m$ wherein X represents a group that enhances adsorption to silver halide, L represents a divalent linkage group, and m is 0 or 1.

16 Claims, No Drawings

SILVER HALIDE PHOTOGRAPHIC MATERIAL

This application is a continuation of application Ser. No. 07/059,946, filed June 9, 1987 abandoned.

FIELD OF THE INVENTION

The present invention relates to a direct positive silver halide photographic material, and a negative type surface latent image-forming silver halide photographic material characterized in that they contain a nucleating agent comprising a novel quaternary ammonium salt having an adsorption promoting group combined with it.

BACKGROUND OF THE INVENTION

Previously, nucleating agents have been used for various applications in a silver halide photographic materials. For example, hydrazines which have been used widely as nucleating agents have been used in direct positive internal latent image-forming silver halide emulsions and have been used for increasing sensitivity and/or gradation in negative type surface latent image-forming silver halide emulsions.

Direct positive photography includes various methods. Such methods include the method of exposing silver halide grains which have been fogged in advance in the presence of a desensitizer followed by their development and the method of exposing silver halide grains having photosensitive nuclei mainly inside the grains followed by their development in the presence of a nucleating agent. The present invention relates to the latter method. In this respect, silver halide emulsions having photosensitive nuclei mainly inside the silver halide grains and which form latent images mainly in the inside of grains are referred to as an internal latent image type silver halide emulsion and should be distinguished from silver halide grains which form latent images mainly on the surface of grains.

Methods for obtaining positive images directly by surface development of an internal latent image type silver halide photographic emulsion in the presence of nucleating agent, as well as photographic emulsions and photosensitive materials used in such methods, have been disclosed in, for example, U.S. Pat. Nos. 2,456,953, 2,497,875, 2,497,876, 2,588,982, 2,592,250, 2,675,318, 3,227,552, and 3,317,322, British Patents 1,011,062, 1,151,363, 1,269,640, and 2,011,391, Japanese Patent Publication Nos. 29405/68 and 38164/74, and Japanese Patent Application (OPI) Nos. 16623/78, 137133/78, 37732/79, 40629/79, 74536/79, 74729/79, 52055/80, and 90940/80 (the term "OPI" as used herein refers to a "published unexamined Japanese patent application").

The nucleating agent may be added to the developing solution in the above-mentioned method to obtain a positive image directly. In addition, nucleating agents may be added to photographic emulsion layers or other appropriate layers in a photosensitive material.

Of the suitable nucleating agents which have been added to a silver halide photosensitive materials, hydrazine compounds have been frequently used. As specific examples of such nucleating agents, there are those nucleating agents disclosed in *Research Disclosure,* RD No. 23510 (November, 1953), RD No. 15162 (November, 1976, Vol. 151), and RD No. 17626 (December, 1978, Vol. 176). In general, hydrazine-containing nucleating agents have large differences between their maximum densities (Dmax) and their minimum densities (Dmin) and have been found to be superior with respect to discrimination. However, they have a drawback in that high pH values (i.e., higher than 11) are necessary for treatment. As nucleating agents which are capable of functioning at low pH values (i.e., not higher than 11), heterocyclic quaternary ammonium salts have been used. Examples of these can be found in U.S. Pat. Nos. 3,615,615, 3,719,494, 3,734,738, 3,759,901, 3,854,956, 4,094,683, and 4,306,016, British Patent 1,283,835, and Japanese Patent Application (OPI) Nos. 3426/77 and 69613/77. In particular, propargyl- or butynyl-substituted heterocyclic quaternary ammonium salt compounds such as those mentioned in U.S. Pat. No. 4,115,122 are excellent nucleating agent with respect to discrimination in direct positive silver halide emulsions. However, in silver halide emulsions, and in particular, color photosensitive materials, when a sensitizing dye is used with the aim of spectral sensitization, a competitive adsorption occurs between the sensitizing dye and the heterocyclic quaternary ammonium-containing nucleating agent. As a result, since quaternary ammonium-containing nucleating agents have weak adsorbing properties, it has been necessary to add a large amount of the nucleating agent. Therefore, with multilayer color photosensitive materials, the use of large amounts of nucleating agents sometimes results in an unevenness of density or in loss of color balance. Furthermore, the nucleating agent has been found to exhibit insufficient performance. In an effort to overcome this problem, quaternary ammonium salt-containing nucleating agents having thioamide groups for promoting adsorption on AgX were developed and disclosed in U.S. Pat. No. 4,471,044. In particular, it was disclosed that the amount of nucleating agent which is necessary to obtain sufficient Dmax is reduced. Also, the reduction in Dmax with time at high temperatures is improved by introducing a difference in adsorption. However, even with these improvements, the effect of these nucleating agents have not been sufficiently satisfactory.

Furthermore, it is known to improve various photographic characteristics by using a nucleating agent in a negative type surface latent image-forming silver halide photographic material. For example, it is known that a negative image of high contrast having a large gamma value (i.e., of 10 or more) can be obtained by processing a surface latent image type silver halide negative emulsion with a processing solution having a high pH (i.e., 11 or more) in the presence of a hydrazine-containing nucleating agent. This is discussed in U.S. Pat. Nos. 2,419,975, 4,224,401, 4,168,977, 4,243,739, 4,272,614 and 4,323,643. Examples of hydrazine-containing nucleating agents having a group for promoting adsorption on silver halide grains are disclosed in U.S. Pat. Nos. 4,385,108 and 4,269,929. Furthermore, it is known that increased sensitivity can be obtained by processing the combination of a negative emulsion and a hydrazine compound at a low pH (i.e., not higher than 11).

It is also known that quaternary ammonium salt-containing compounds act to promote development in a silver halide negative emulsion-containing photosensitive material. This is discussed, for example, in U.S. Pat. No. 4,135,931, Japanese Patent Application (OPI) Nos. 114328/77 and 121321/77, West German Patent 2,647,940, and Belgian Patent 721,658.

However, the use of the nucleating agents discussed above has been found to necessitate an increase in an amount of nucleating agent which is added to achieve a sufficient effect and the effect is largely dependent on the particular processing method used.

It is known that a direct positive photosensitive material provides a re-reversal negative image in the region of a large amount of light and it is also known that when a direct positive photosensitive material is exposed for a short time at high illumination (high illuminance exposure) or is exposed for a long time at low illumination (low illuminance exposure), the re-reversal negative image is liable to appear at the former exposure in comparison with the latter exposure provided that the amount of light is the same. Therefore, it has been desired to provide a direct positive photosensitive material which minimizes the formation of the re-reversal negative images at high illuminance exposure.

Further, it has also been desired to provide a direct positive photosensitive material which shows reversal effect in the initial stage of development exposure (e.g., 40 sec. or 60 sec. development).

SUMMARY OF THE INVENTION

Accordingly, the first object of the invention is to provide a direct positive photosensitive material which exhibits sufficient reversal properties even with a processing solution having a relatively low pH value.

The second object of the invention is to provide a direct positive photosensitive material which contains a nucleating agent which has a desired nucleating effect even when small amounts are added without hindering the spectral sensitization of photosensitive material.

The third object of the invention is to provide a multilayer color direct positive photosensitive material having uniform density and good color balance.

The fourth object of the invention is to provide a direct positive photosensitive material which does not substantially adversely affect photographic properties such as the Dmax of the image when stored for long periods of time at high temperatures and high humidity.

The fifth object of the invention is to provide a direct positive photosensitive material which minimizes the formation of re-reversal negative images at high illuminance exposure.

The sixth object of the invention is to provide a direct positive photosensitive material which shows reversal effect in the initial stage of development exposure (e.g., 40 sec. or 60 sec. development).

The seventh object of the invention is to provide a negative type photosensitive material having increased photographic sensitivity.

DETAILED DESCRIPTION OF THE INVENTION

The above-mentioned objects of the invention have been attained by producing a silver halide photographic material, which comprises a support having provided thereon at least one light-sensitive silver halide emulsion layer, the silver halide emulsion layer or at least one other hydrophilic colloid layer containing at least one heterocyclic quaternary ammonium salt compound represented by the following general formula (I):

(I)

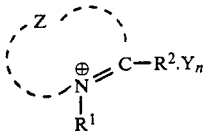

wherein Z represents non-metallic atoms necessary for forming a 5- or 6-membered heterocyclic ring and which may be substituted with a substituent group; $R^1$ represents an aliphatic group; $R^2$ represents a hydrogen atom, an aliphatic group, or an aromatic group; $R^1$ and $R^2$ may combine with each other to form a ring; $R^1$ and $R^2$ each may be substituted with a substituent group; Y represents a charge-balancing counter ion; and n is 0 or 1; provided that at least one of substituents $R^1$, $R^2$, and Z has an acyl group, a hydrazine group, or a hydrazone group or $R^1$ and $R^2$ form a 6-membered dihydropyridinium skeleton, and, further, at least one of $R^1$, $R^2$, and Z includes the group $-X-(L)_m$, wherein X is a group that enhances adsorption to silver halide, L is a divalent linkage group, and m is 0 or 1.

The heterocyclic quaternary ammonium salt compound represented by general formula (I) is preferably contained in an internal latent image type silver halide photographic emulsion layer with a positive type photosensitive material or in a surface latent image type silver halide photographic emulsion layer with a negative type photosensitive material or in a hydrophilic colloid layer adjacent to the above-mentioned photographic emulsion layer.

As the heterocyclic ring completed by Z, there may be mentioned, for example, quinolinium, benzothiazolium, benzimidazolium, pyridinium, thiazolinium, thiazolium, naphthothiazolium, selenazolium, benzoselenazolium, imidazolium, tetrazolium, 3H-indolium, pyrrolinium, acridinium, phenanthridinium, isoquinolinium, oxazolium, naphthoxazolium, and benzoxazolium nuclei.

A heterocyclic ring completed by Z may be substituted with a substituent. Suitable substituents for Z include an alkyl group preferably having 1 to 18 carbon atoms, such as a methyl, ethyl, or cyclohexyl group, an alkenyl group preferably having 2 to 18 carbon atoms, such as a vinyl, allyl, or butenyl group, an aralkyl group preferably having 7 to 20 carbon atoms, such as a benzyl group, an aromatic group preferably having 6 to 20 carbon atoms, such as a phenyl or naphthyl group, a hydroxyl group, an aliphatic oxy group, such as an alkoxy, alkenyloxy, or alkynyloxy group, and preferably an aliphatic oxy group having 1 to 18 carbon atoms, such as a methoxy, ethoxy or allyloxy group, an aromatic oxy group preferably having 6 to 20 carbon atoms, such as a phenyloxy group, a halogen atom such as a fluorine, chlorine, bromine, or iodine atom, an amino group, a substituted amino group preferably having 1 to 18 carbon atoms, such as a methylamino, dimethylamino, or phenylamino group, an aliphatic thio group preferably having 1 to 18 carbon atoms, such as a methylthio group, an aromatic thio group preferably having 6 to 20 carbon atoms, such as a phenylthio group, an acyloxy group preferably having 1 to 18 carbon atoms, such as an acetoxy or benzoxy group, a sulfonyloxy group preferably having 1 to 18 carbon atoms, such as a methanesulfonyloxy cr toluenesulfonyloxy group, an acylamino group preferably having 1 to 18 carbon atoms, such as acetylamino or benzoylamino group, a sulfonylamino group preferably having 1 to 18 carbon atoms, such as a methanesulfonylamino or benzenesulfonylamino group, a carboxyl group, an aliphatic oxycarbonyl group preferably having 1 to 18 carbon atoms, such as a methoxycarbonyl group, an aromatic oxycarbonyl group preferably having 7 to 20 carbon atoms, such as a phenoxycarbonyl group, an acyl group preferably having 1 to 20 carbon atoms, such as a formyl, acetyl or benzoyl group, a carbamoyl group, an N-substituted carbamoyl group preferably having 2 to 20 carbon atoms, such as an N-methylcarbamoyl or N-phenylcarbamoyl group, a sulfamoyl group, an N-substituted sulfamoyl group preferably having 1 to 18 carbon atoms, such as an N-methylsulfamoyl, N,N-dimethylsulfamoyl, or N-phenylsulfamoyl group, a sulfo group, a cyano group, a ureido group, a substituted ureido group preferably having 2 to 20 carbon atoms, such as a 3-methylureido or 3-phenylureido group, a substituted urethane group preferably having 2 to 20 carbon atoms, such as a methoxycarbonylamino or phenoxycarbonylamino group, a carbonic acid ester group preferably having 2 to 20 carbon atoms, such as an ethoxycarbonyloxy or phenoxycarbonyloxy group, and a substituted or unsubstituted imino group preferably having 18 or less carbon atoms, such as an N-methylimino group.

As the substituent for Z, at least one of the above-mentioned substituents may be selected, and if two or more substituents are selected, they may be the same or different from each other. Furthermore, the above-mentioned substituent may be substituted with another substituent. The above-mentioned substituent for Z may themselves be substituted with a hydrazine or hydrazone group.

The heterocyclic quaternary ammonium salt compound may have a heterocyclic quaternary ammonium group completed through an appropriate linkage group L as substituent groups for Z, and, in such a case, it assumes so-called dimer structure.

Suitable heterocyclic rings completed by Z include: (1) quinolinium, quinaldinium, lepidinium, 6-ethoxyquinaldinium, 2,4-dimethylquinolinium, 3-acetylaminoquinolinium, and 6-acetylaminoquinaldinium nuclei as the quinolinium nucleus; (2) 2-methylbenzothiazolium, 5-hydroxybenzothiazolium, 2,5,6-trimethylbenzothiazolium, 2-methyl-5-phenylbenzothiazolium, and 5-chlorobenzothiazolium nuclei as the benzothiazolium nucleus; (3) 1-ethyl-5,6-dichloro-2-methylbenzimidazolium, 1-ethyl-2methylbenzimidazolium, and 5,6-dichloro-2-methyl-11-phenylbenzimidazolium nuclei as the benzimidazolium nucleus; (4) pyridinium, 2-methylpyridinium, 2,4,6trimethylpyridinium, and 4-phenylpyridinium nuclei as the pyridinium nucleus; (5) 2-methyl-2-thiazolinium and 2-p-hydroxyphenyl-5-methyl-2-thiazolinium nuclei as the thiazolinium nucleus; (6) thiazolium, 2,4-dimethylthiazolium, and 2,4,5-trimethylthiazolium nuclei as the thiazolium nucleus; (7) α-naphthothiazolium, 5-methoxy2-methyl-β-naphthothiazolium, and 7-hydroxy-2-methyl-α-naphthothiazolium nuclei as the naphthothiazolium nucleus; (8) selenazolium and 2-methyl-4-phenylselenazolium nuclei as the selenazolium nucleus; (9) benzoselenazolium and 5-chloro-2-methylbenzoselenazolium nuclei as the benzoselenazolium nucleus; (10) 1,2-dimethylimidazolium and 1-ethyl-2,4,5-trimethylimidazolium nuclei as the imidazolium nucleus; (11) tetrazolium, 1-phenyltetrazolium, 2-phenyltetrazolium, and 1,5-dimethyltetrazolium nuclei as the tetrazolium nucleus; (12) 3H-indolium and 3,3-dimethylindolium nuclei as the 3H-indolium nucleus; (13) 2-methylpyrrolinium nucleus as the pyrrolinium nucleus; (14) acridinium and 9-methyl acridinium nuclei as the acridinium nucleus; (15) 6-methylphenanthridinium nucleus as the phenanthridinium nucleus; (16) isoquinolinium and 5-hydroxyisoquinolinium nuclei as the isoquinolinium nucleus; (17) oxazolium, 2,4-dimethyloxazolium and 2-methyl-4,5-diphenyloxazolium nuclei as the oxazolium nucleus; (18) α-naphthoxazolium, 2-methyl-β,β-naphthoxazolium and 7-hydroxy-2-methyl-β-naphthoxazolium nuclei as the naphthoxazolium nucleus; and (19) benzoxazolium, 5-chloro-2-methylbenzoxazolium, 2,5-dimethylbenzoxazolium, 5-chloro-2-methylbenzoxazolium and 6-hydroxy-2-methylbenzoxazolium nuclei as the benzoxazolium nucleus.

The preferred heterocyclic rings completed by Z include quinolinium, benzothiazolium, benzimidazolium, pyridinium, aoridinium, phenanthridinium, and isoquinolinium nuclei. Of these, quinolinium, benzothiazolium and benzimidazolium nuclei are more preferred with quinolinium and benzothiazolium nuclei being the most preferred ones.

Aliphatic groups represented by $R^1$ and $R^2$ may be unsubstituted alkyl groups having 1 to 18 carbon atoms such as a methyl, ethyl, isopropyl or hexadecyl group, and substituted alkyl groups having a carbon atom number of 1 to 18 of the alkyl moiety. The substituent for aliphatic groups represented by $R^1$ and $R^2$ may be any of those discussed above with respect to Z. Specific examples of the aliphatic groups represented by $R^1$ and $R^2$ are sulfoalkyl groups such as 2-sulfoethyl, 3-sulfopropyl or 4-sulfobutyl groups, carboxyalkyl groups such as 2-carboxyethyl groups, hydroxyalkyl groups such as 2-hydroxyethyl groups, alkoxyalkyl groups such as 2-methoxyethyl, 2-hydroxyethoxymethyl or 2-methoxyethoxy groups, acyloxlalkyl groups such as 2-acetoxyethyl groups, dialkylaminoalkyl groups such as 2-dimethylaminoethyl groups, aralkyl groups such as benzyl groups, and alkenyl groups such as allyl groups. Furthermore, the above-mentioned aliphatic groups represented by $R^1$ and $R^2$ may be substituted with a hydrazine or hydrazone group.

Aromatic groups represented by $R^2$ may be those having 6 to 20 carbon atoms, and suitable aromatic groups include phenyl and naphthyl groups. As the substituent, the same groups discussed with respect to Z are useful. Substituted aromatic groups represented by $R^2$ include, for example, alkyl-substituted aryl groups such as 4-methylphenyl groups, alkoxyaryl groups such as 3-methoxyphenyl groups, hydroxyaryl groups such as 4-hydroxyphenyl groups, halogen-substituted aryl groups such as 4-chloro-1-naphthyl groups, and sulfoaryl groups such as 4-sulfophenyl groups. The above-mentioned aromatic groups represented by $R^2$ may be further substituted with a hydrazine or hydrazone group.

At least one of substituents of $R^1$, $R^2$, and Z has an acyl, hydrazine, or hydrazone group, or $R^1$ and $R^2$ form a 6-membered ring to form a dihydropyridinium skeleton.

The preferred hydrazine groups are those represented by the following general formula (II):

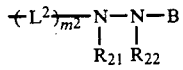

(II)

wherein $L^2$ represents a divalent linkage group; $m^2$ represents 0 or 1; B represents a formul, acyl, alkylsulfonyl, arylsulfonyl, alkylsulfinyl, arylsulfinyl, carbamoyl, alkoxycarbonyl, aryloxycarbonyl, sulfinamoyl, alkoxysulfonyl, thioacyl, thiocarbamoyl, sulfamoyl, heterocyclic, aliphatic, or aromatic group; and $R^{21}$ and $R^{22}$ both represent hydrogen atoms or one of them represents a hydrogen atom and the other represents a substituted or unsubstituted alkylsulfonyl group, a substituted or unsubstituted arylsulfonyl group, or a substituted or unsubstituted acyl group.

The preferred hydrazone groups are those represented by general formula (IIIa) and general formula (IIIb):

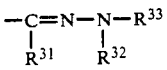

(IIIa)

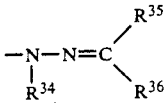

(IIIb)

wherein $R^{31}$, $R^{32}$, $R^{33}$, $R^{34}$, $R^{35}$, and $R^{36}$ each represents a hydrogen atom, or an aliphatic, aromatic or heterocyclic group independently, and $R^{32}$ and $R^{33}$, or $R^{35}$ and $R^{36}$ may combine with each other to form a ring.

If $R^1$ and $R^2$ form a 6-membered ring, it is preferred that the resulting compound represented by general formula (I) is a compound represented by the following general formula (IV):

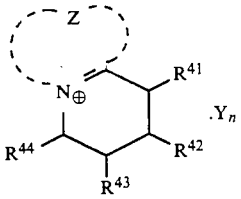

(IV)

wherein Z, Y, and n have the same meaning as Z, Y, and n defined with respect to general formula (I), and $R^{41}$, $R^{42}$, $R^{43}$, and $R^{44}$ each represents a group such as those discussed as the substituents for $R^1$ or $R^2$ in general formula (I) independently.

As the acyl group, a formyl group or an oxy group is preferred, and particularly preferred are those compounds represented by the following general formula (V):

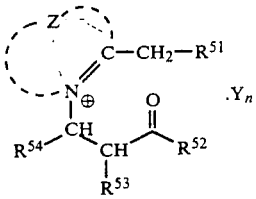

(V)

wherein Z, Y, and n have the same meaning as Z, Y, and n in general formula (I); $R^{52}$ represents a hydrogen atom, or an alkyl, aryl, or aralkyl group; and $R^{51}$, $R^{53}$, and $R^{54}$ each represents a group such as those mentioned as the substituents for $R^1$ or $R^2$ in general formula (I) independently.

Preferred examples of group X which enhances adsorption to silver halide include thioamide groups, mercapto groups, and 5- or 6-membered nitrogen-containing heterocyclic groups.

A thioamide group represented by X for promoting adsorption may be a divalent group represented by

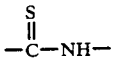

and it may be a part of cyclic structure or preferably may be a noncyclic thioamide group. Useful thioamide groups for promoting adsorption may be selected from among those disclosed in U.S. Pat. Nos. 4,030,925, 4,031,127, 4,080,207, 4,245,037, 4,255,511, 4,266,013, and 4,276,364 and in *Research Disclosure,* RD No. 15162 (Vol. 151, November, 1976) and RD No. 17626 (Vol. 176, December, 1978). A specially preferred thioamide group is one represented by the following general formula (VI):

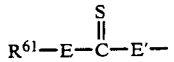

(VI)

wherein one of E and E′ represents $-N(R^{62})-$ and the other represents -O-, -S-, or $NR^{63}$; $R^{61}$ represents a hydrogen atom, or an aliphatic or aromatic group, or combines with E or E′ to form a 5- or 6-membered heterocyclic ring; and $R^{62}$ and $R^{63}$ each represents a hydrogen atom or an aliphatic or aromatic group independently.

Thioamides represented by general formula (VI) include thioureas, thiourethanes, and dithiocarbamic acid esters. Examples of the combination of $R^{61}$ with E or E′ to form a ring include nuclei regarded as an acid nucleus of merocyanine dye, and examples of the nuclei include 4-thiazoline-2-thione, thiazolidine-2-thione, 4-oxazoline-2-thione, oxazolidine-2-thione, 2-pyrazolinethione, 4-imidazoline-2-thione, 2-thiohydantoin, rhodanine, isorhodanine, 2-thio-2,4-oxazolidinedione, thiobarbituric acid, tetrazoline-5-thione, 1,2,4-triazoline-3-thione, 1,3,4-thiadiazoline-2-thione, 1,3,4-oxadiazoline-2-thione, benzimidazoline-2-thione, benzoxazoline-2-thione and benzothiazoline-2-thione. Furthermore, they may have a substituent or substituents.

The mercapto group represented as X for promoting adsorption may be an SH group combining directly with $R^1$, $R^2$, or Z or an SH group combining with a substituent for $R^1$, $R^2$, or Z. Examples of the mercapto group include aliphatic mercapto, aromatic mercapto, and heterocyclic mercapto groups (some groups of which have a nitrogen atom adjacent to a carbon atom having an SH group combined therewith in a heterocyclic ring and have been already described as a ring-forming thioamide group that is a tautomer of the group). Examples of an aliphatic mercapto group include mercaptoalkyl groups such as a mercaptoethyl or mercaptopropyl group, mercaptoalkenyl groups such as a mercaptopropenyl group, and mercaptoalkynyl groups such as a mercaptobutynyl group. Examples of the aromatic mercapto group include mercaptophenyl groups and mercaptonaphthyl groups. Examples of heterocyclic mercapto groups, in addition to ones as mentioned in ring-forming thioamide groups, include 4-mercaptopyridyl, 5-mercaptoquinolinyl, and 6mercaptobenzothiazolyl groups.

Examples of the 5- or 6-membered nitrogen-containing heterocyclic ring represented by X for promoting adsorption include 5- or 6-membered nitrogen-containing heterocyclic rings which include a combination of nitrogen, oxygen, sulfur and carbon. Those preferred include benzotriazole, triazole, tetrazole, indazole, benzimidazole, imidazole, benzothiazole, thiazole, benzoxazole, oxazole, thiadiazole, oxadiazole and triazine. They may also include an appropriate substituent such as those mentioned as the substituents for Z. As the nitrogen-containing heterocyclic ring, benzotriazole, triazole, tetrazole, and indazole are further preferred, and benzotriazole is most preferred.

Preferred specific examples of the nitrogen-containing heterocyclic group include benzotriazole-5-yl, 6-chlorobenzotriazole-5-yl, benzotriazole-5-carbonyl, 5-phenyl-1,3,4-triazole-2-yl, 4-(5-methyl-1,3,4-triazole-2-yl)benzoyl, 1H-tetrazole-5-yl and 3-cyanoindazole-5-yl.

The divalent linkage group represented by L or $L^2$ in general formula (II) is a group of an atom or atomic group containing at least one of C, N, S, and O. Specific examples of the divalent linkage group include an alkylene group, an alkenylene group, an alkynylene group, an arylene group, —O—, —S—, —NH—, —N=, —CO— and —$SO_2$— (and which may have a substituent). They may also be used in the form of a single group or of a mixture of two or more groups. More specifically, L and $L^2$ may be: (1) alkylene groups preferably having 1 to 12 carbon atoms such as a methylene, ethylene or trimethylene group, (2) alkenylene groups preferably having 2 to 12 carbon atoms such as a vinylene or butenylene group, (3) alkynylene groups preferably having 2 to 12 carbon atoms such as an ethynylene or butynylene group, (4) arylene groups preferably having 6 to 10 carbon atoms such as a phenylene or naphthylene group, (5) —O—, (6) —S—, (7) —NH—, (8) —N=, (9) —CO— and (10) —$SO_2$—. Furthermore, L and $L^2$ may be a combination of these such as

(11) $-O-\overset{O}{\overset{\|}{C}}-$,

(12) $-NH-\overset{O}{\overset{\|}{C}}-$,

(13) —$NHSO_2$—, (14)

$-O-\overset{O}{\overset{\|}{C}}NH-$,

(15) $-NH\overset{O}{\overset{\|}{C}}-NH-$, and an appropriate combination of (1) to (4) with (5) to (16) such as -(alkylene)-$\overset{O}{\overset{\|}{C}}-NH-$, —(arylene)—$SO_2NH$— and -(arylene)- $NH\overset{O}{\overset{\|}{C}}NH-$.

The charge balancing counter ion Y is an arbitrary negative ion which compensates for the positive charge caused by a quaternary ammonium salt in a heterocyclic ring. Examples of Y include a bromine ion, a chlorine ion, an iodine ion, a p-toluenesulfonic acid ion, an ethylsulfonic acid ion, a perchloric acid ion, a trifluoromethanesulfonic acid ion, and a thiocyan ion. In such a case, n is 1. If the heterocyclic quaternary ammonium salt contains, a negative ionic substituent group, such as a sulfoalkyl group, the salt can assume the form of betaine. In such a case, the counter ion is unnecessary and n is 0. If the heterocyclic quaternary ammonium salt has two negative ionic substituents such as two sulfoalkyl groups, Y represents a positive ionic counter ion, and Y may h=an alkali metallic ion such as a sodium ion and a potassium ion, and an ammonium salt such as triethyl ammonium.

Specific examples of compounds which are useful in the invention will be set forth below. However, the invention is not to be limited to these specific examples.

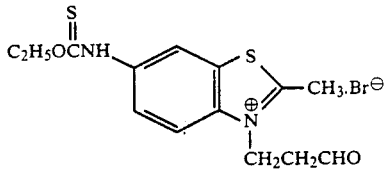

(1)

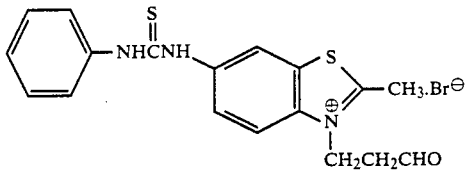

(2)

-continued
(3)
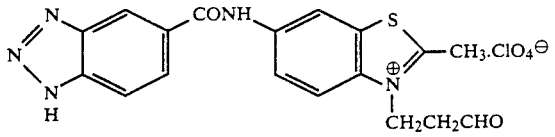
(4)
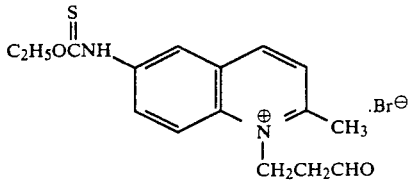
(5)
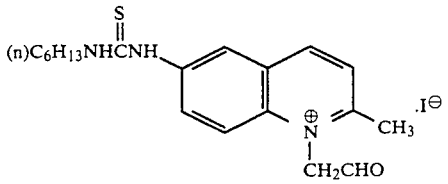
(6)
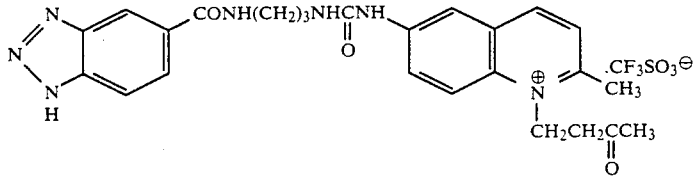
(7)
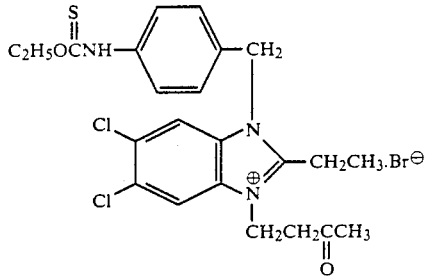
(8)
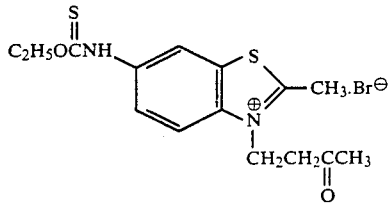
(9)
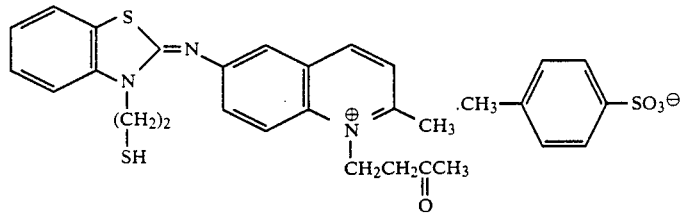

-continued
(10)
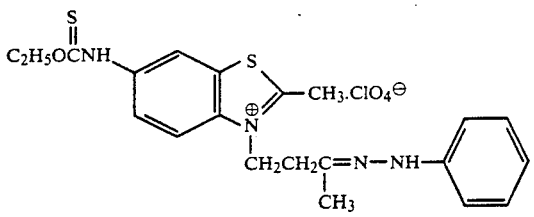
(11)
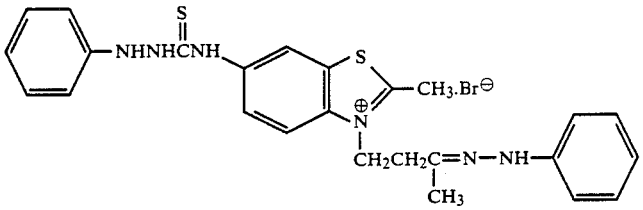
(12)
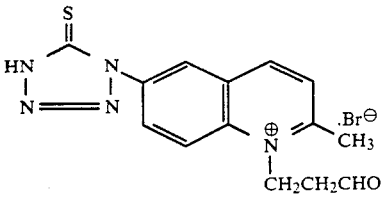
(13)
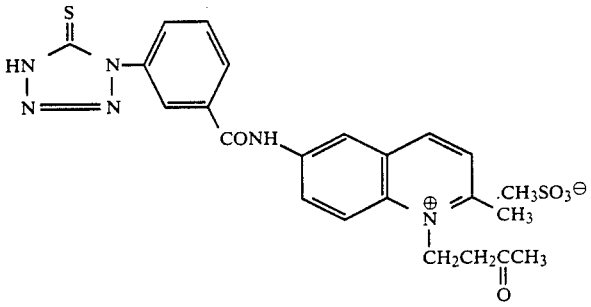
(14)
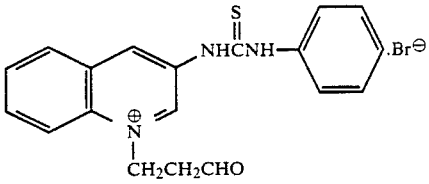
(15)
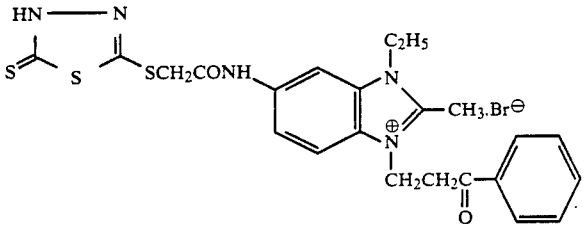
(16)
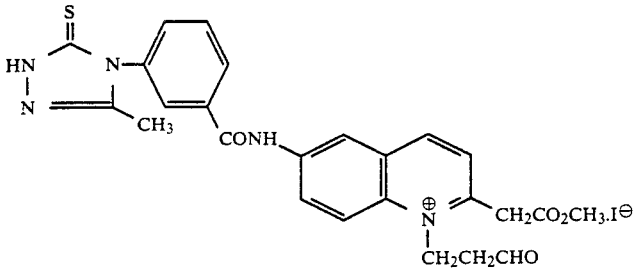

-continued
(17)
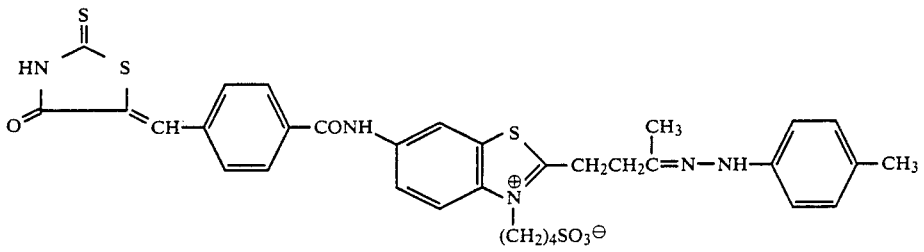
(18)
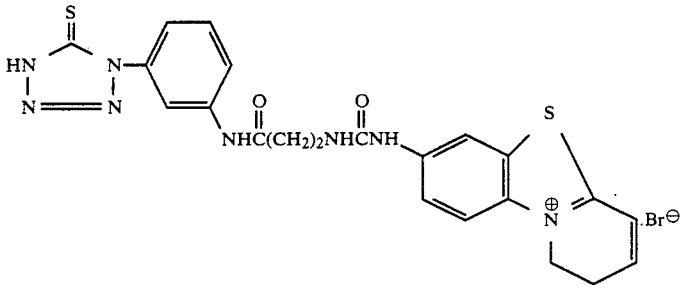
(19)
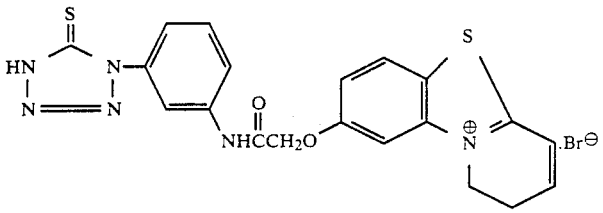
(20)
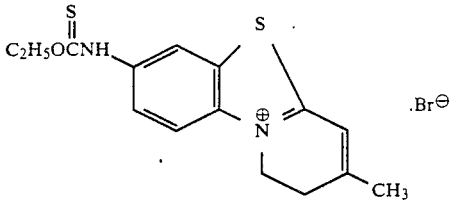
(21)
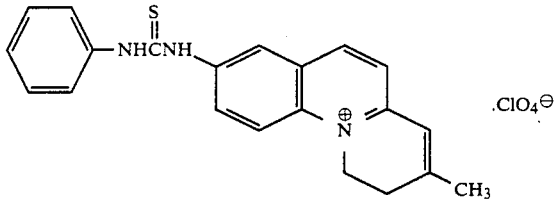
(22)
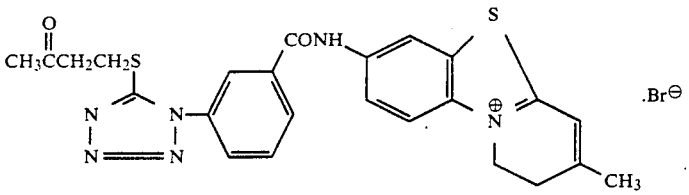
(23)
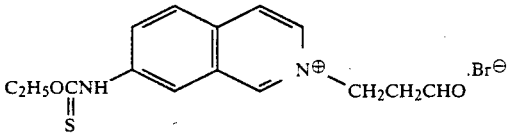

-continued
(24)
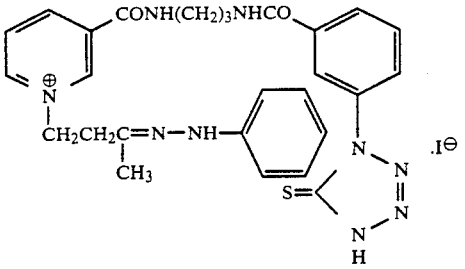
(25)
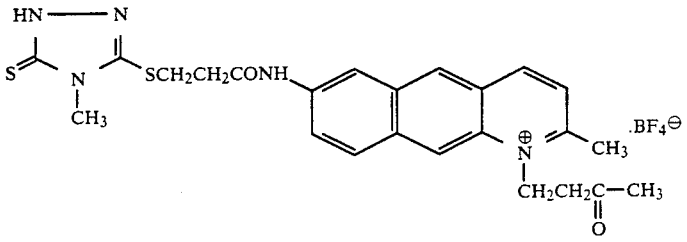
(26)
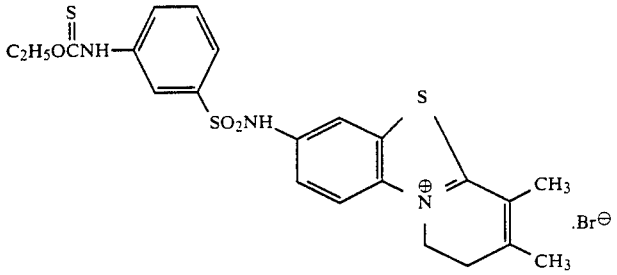
(27)
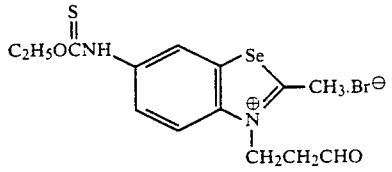
(28)
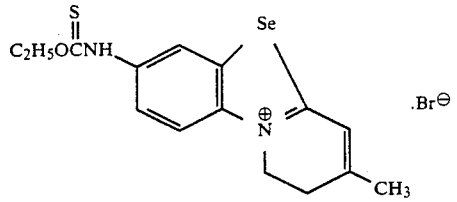
(29)
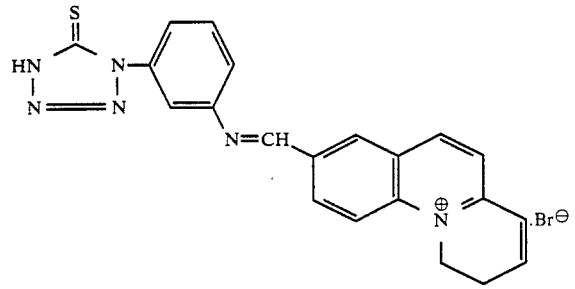

-continued (30)

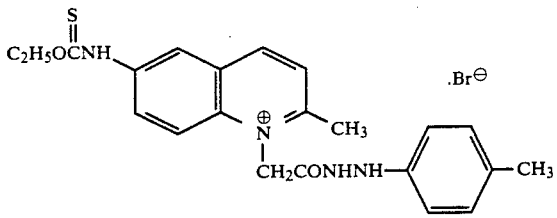

(31)

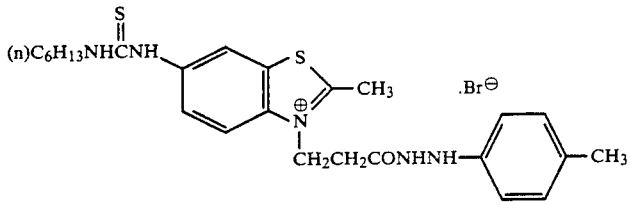

(32)

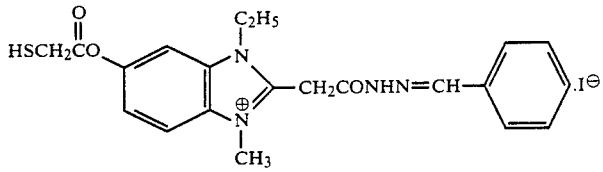

(33)

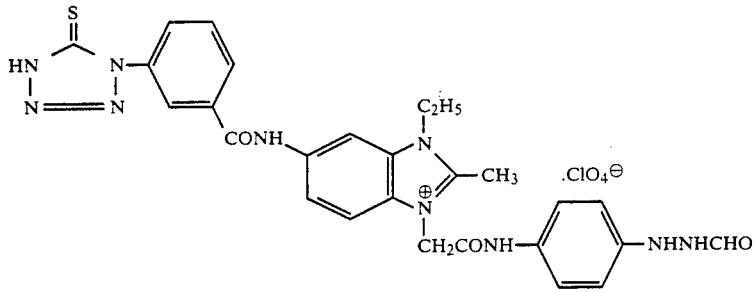

Generally, the compound of the present invention can be synthesized by the following method. First, the compound

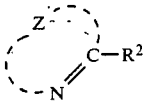

is converted into a quaternary ammonium compound with a converting agent, $R^1$-Y, followed by reacting the quaternary ammonium compound with X

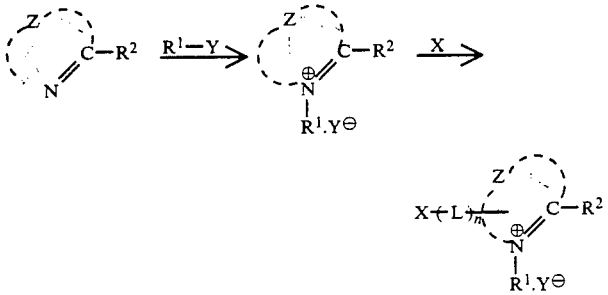

wherein $R^2$, Z, $R^1$, Y, L, and n have the same meaning as $R^2$, Z, $R^1$, Y, L, and n defined with respect to general formula (I).

If $R^1$ and $R^2$ are defined by general formula (II), (IIIa), (IIIb), or , methods such as those disclosed in U.S. Pat. Nos. 3,759,901 and 3,734,738, and Japanese Patent Application (OPI) No. 3426/77 may be used as specific synthetic formulations for the compound of the present invention. If $R^1$ and $R^2$ are defined by general formula (IV), the compound of the present invention may be synthesized by a method such as that disclosed in U.S. Pat. No. 3,719,494.

Reaction conditions used for introduction of X vary with L. If X is a thioamide group and L is only a linkage chain, X may be introduced by a method such as that disclosed in U.S. Pat. No. 4,471,044. Furthermore, if L is a carbonamide, it may be introduced by reacting a carboxylic acid chloride or a derivative of phenyl carboxylate with an amine derivative in the presence of a base such as pyridine or triethylamine according to a usual method. Also, it may be introduced by reacting a carboxylic acid derivative with an amine derivative in the presence of a condensing agent such as dicyclohexyl carbodiimide. If L is a sulfonamide group, it may be synthesized by reacting a sulfonic acid chloride derivative with an amine derivative in the presence of a base such as pyridine or triethylamine. If L is a ureido group, it may be synthesized by reacting an isocyanic acid ester or a phenylurethane derivative with an amine derivative. If L is an ether group, it may be synthesized by reacting an alcohol derivative with a halide derivative in the presence of an alkali material such as potassium carbonate, sodium hydroxide, or t-butoxy calcium. If L is an imine group, it may be synthesized by reacting an amine derivative with a carbonyl derivative such as an aldehyde derivative or ketone derivative in the presence of an acid catalyst such as hydrochloric acid or sulfuric acid. If L is another linkage group, it may also be synthesized according to a usual method.

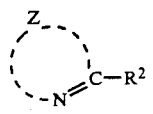

may be converted into a quaternary ammonium compound with $R^1$-Y by a reaction of the two compounds in the absence of solvent or, alternatively, in a solvent such as a hydrocarbon (e.g., toluene or xylene), halogenated hydrocarbon (e.g., chloroform, carbon tetrachloride, 1,2-dichloroethene, or 1,1,2,2-tetrachloroethane), or an ether solvent (e.g., tetrahydrofuran or anisole) at a temperature ranging from about room temperature to about 150° C. To the reaction product, a solvent which does not solubilize the product such as ethyl acetate or acetone is added to precipitate crystals, which are then separated by filtration. If the crystallizability is poor, the reaction product may be crystallized in most cases by salt exchange of counter ions $Y^{\ominus}$ to other counter ions.

Specific examples of synthetic methods for compounds of the invention will be described hereinafter.

SYNTHESIS EXAMPLE 1

Synthesis of Compound (1)

After 2.1 g of 6-isothiocyanate-2-methylbenzothiazole was reacted with 2.2 g of 3-bromopropanol dimethyl acetal at 80° C. for 3 hours, 10 ml of ethanol was added to the reaction product and the mixture was heated under reflux for 1 hour. After the mixture was allowed to cool, a solvent was distilled off under reduced pressure with a rotary evaporator. Ether was then added to form a slurry. The solid matter was separated by filtration and it was recrystallized with 48% hydrobromic acid. Thus, 0.9 g of object compound was obtained at a yield of 23%.

SYNTHESIS EXAMPLE 2

Synthesis of Compound (8)

2.1 g of 6-isothiocyanate-2-methylbenzothiazole was dissolved in 20 m( of acetone and 4 g of 48% hydrobromic acid was added to the solution at room temperature. After the mixture was stirred at room temperature for 1 hour, the precipitated crystals were separated by filtration, washed with acetone, and then dried at 50° C. The crystal which was obtained was reacted with 1.4 g of methyl vinyl ketone in 10 ml of N,N-dimethylformamide at room temperature for 3 hours. The precipitated crystal (A) was then separated by filtration and then dissolved in 10 ml of ethanol. The solution was heated under reflux for 1 hour. After the solution was allowed to cool, the solvent was distilled off under reduced pressure with a rotary evaporator. Ether was then added to the concentrated reaction product to form a slurry. The solid matter was separated by filtration and recrystallized with acetone. Thus, 1.8 g of object compound was obtained at a yield of 45%.

SYNTHESIS EXAMPLE 3

Synthesis of Compound (11)

2.5 g of crystal (A) obtained in Synthesis Example 2 and 1.6 g of phenylhydrazine were dissolved in 30 ml of ethanol, then one drop of 1.5% hydrobromic acid was added. The mixture was then reacted at room temperature for 2 hours. The precipitated crystals were separated by filtration and then recrystallized with methanol. 1.7 g of object compound was obtained at a yield of 43%.

SYNTHESIS EXAMPLE 4

Synthesis of Compound (20)

2.8 g of Compound (8) and 1.5 g of pyridine were dissolved in 20 ml of methanol and were reacted in a nitrogen atmosphere at 60° C. for 15 minutes. After the reaction mixture was allowed to cool, the precipitated crystal was separated by filtration and then recrystallized with acetone. 1.7 g of object compound was obtained at a yield of 64%.

To incorporated a compound such as that represented by general formula (I) in a photographic material, the compound in the form of its solution in a water-miscible organic solvent such as an alcohol (e.g., methanol or ethanol), an ester (e.g., ethyl acetate), or a ketone (e.g., acetone), or, alternatively, in the form of its aqueous solution if it is water-soluble, is added to a hydrophilic colloid solution.

When the compound is added to a photographic emulsion, it may be added at any arbitrary time from the beginning of chemical ripening of the emulsion to just before the application of emulsion. However, it is preferred to add the compound after completion of chemical ripening.

A nucleating agent represented by general formula (I) of the present invention may be present in a hydrophilic colloid layer adjacent to a silver halide emulsion layer. However, it is preferred that the nucleating agent is present in a silver halide emulsion layer. The amount of nucleating agent varies with characteristics such as the amount of silver halide emulsion, the chemical structure of the nucleating agent and development conditions. Therefore, the amount may vary over an extensive range. However, a suitable range is from about $1\times10^{-7}$ mol to about $1\times10^{-2}$ mol per mol of silver in a silver halide emulsion, and the preferred range is from about $1\times10^{-6}$ mol to about $1\times10^{-3}$ mol per mol of silver in a silver halide emulsion.

The preferred amount of nucleating agent used ranges from about $1\times10^{-5}$ mol to $1\times10^{-3}$ mol per mol of silver with a positive type emulsion and $1\times10^{-5}$ mol to $1\times10^{-3}$ mol per mol of silver with a negative type emulsion.

The silver halide photographic material of the present invention may be a photosensitive material for photography or printing, and may be a so-called "negative" photosensitive material which forms a negative image through the exposure to a positive object or a direct positive photosensitive material which forms a positive image directly without a reversal processing. Furthermore, the photographic material of the present invention may be a black-and-white photosensitive material such as those used for X-ray photography and for a silver salt diffusion transfer methods. Also, the photographic material may be a color photosensitive material. As the color photosensitive material, the photosensitive material of the present invention may be applied to "conventional" color photosensitive materials using a color coupler as a color image-donating compound (hereinafter referred to as a "coloring material"), to heat-developable color photosensitive materials such as those disclosed in U.S. Pat. No. 4,500,626, Japanese Patent Application (OPI) Nos. 218443/84, 133449/85 and 238056/86, to photosensitive materials for color diffusion transfer which utilize the diffusion of dye, and to other various photosensitive materials.

Silver halide emulsions usable in the invention are usually sensitized chemically. Examples of sensitization methods include a sulfur sensitization method using a sulfur-containing compound which reacts with active gelatin or silver such as thiosulfates, thioureas, mercapto compounds and rhodanines; a reduction sensitization method using a reducing substance such as stannous salts, amines, hydrazine derivatives, formamidine sulfinic acid and silane compounds; and a noble metal sensitization method using a noble metallic compound such as gold complex salts, or complex salts of a Group VIII metal of the Periodic Table such as Pt, Ir and Pd. These methods may be used in the form of a single method or in combination.

Examples of the silver halide composition of silver halide emulsion which is usable in the present invention include silver bromide, silver iodide, silver chloride, silver chlorobromide, silver bromoiodide, and silver chlorobromoiodide. Preferred silver halide emulsions contain at least 50 mol% of silver bromide and the most preferred emulsions are silver bromoiodide emulsions, which contain from about 0 to about 15 mol% of silver iodide. As the crystalline form of silver halide grains, grains of all crystalline forms including tabular grains and regular grains such as octahedral and cubic shaped grains may be used. As the tabular grains, those having an aspect ratio of at least 5, and in particular, those having an aspect ratio of about 5 to 20 such as those disclosed in Japanese Patent Application (OPI) No. 108528/83 may be used.

Silver halide emulsions may be those of type which form a latent image mainly on the surface of grain (i.e., "negative emulsions") or those which form a latent image mainly inside grains (i.e., internal latent image type emulsions which are used as direct positive emulsions). It is preferred to apply the present invention to the direct positive emulsions.

An internal latent image type (hereinafter referred to as "internal latent type") silver halide emulsion is characterized by the fact that its maximum density when it is developed with an "internal" developing solution is larger than its maximum density when it is developed with a "surface" developing solution.

Examples of internal latent type silver halide emulsions to which the present invention may be applied include conversion emulsions such as those disclosed in U.S. Pat. No. 2,592,250 which are obtained by a process to convert silver salt grains of high solubility, such as silver chloride, into silver salt grains of low solubility such as silver (iodo)bromide (i.e., a catastrophic precipitation process); core/shell emulsions such as those disclosed in U.S. Pat. No. 3,206,313 which have a silver halide shell disposed on a core grain by a process wherein a fine grain emulsion is mixed with a large grain core emulsion which has been chemically sensitized followed by ripening the mixture; core/shell emulsions such as those disclosed in British Patent 1,027,146 and U.S. Pat. No. 3,761,276 which have a silver halide shell disposed on a core grain by a process wherein a solution of soluble silver salt and a solution of soluble halide are added simultaneously to a monodispersed core emulsion which has been chemically sensitized while maintaining the concentration of silver ions constant; localized halogen type emulsions such as those disclosed in U.S. Pat. No. 3,935,014 in which an emulsion grain is constructed in a manner such that it has two or more lamination layers and the first phase and second phase in the grain are different in a halogen composition; and emulsions such as those disclosed in U.S. Pat. No. 3,447,927 which contain a different metal prepared by a process wherein silver halide grains are formed in an acid medium containing trivalent metallic ions.

Of the above-mentioned internal latent type emulsions, core/shell type emulsions are ones to which the present invention is preferably applied.

The nucleating agent of the present invention may be combined with known nucleating agents. These conventional nucleating agents are not specially limitative. Representative examples of conventional nucleating agents include hydrazines such as those disclosed in U.S. Pat. Nos. 2,563,785 and 2,588,982; hydrazides and hydrazones such as those disclosed in U.S. Pat. No. 3,227,552; heterocyclic quaternary salt compounds such as those disclosed in British Patent 1,283,835, Japanese Patent Application (OPI) No. 69613/77, and U.S. Pat. Nos. 3,615,615, 3,719,494, 3,734,738, 4,094,683 and 4,115,122; sensitizing dyes having a nucleating substituent in the molecule such as those disclosed in U.S. Pat. No. 3,718,470; acylhydrazine-containing compounds combined with thiourea such as those disclosed in U.S. Pat. Nos. 4,030,925, 4,031,127, 4,245,037, 4,255,511, 4,266,013 and 4,276,364 and British Patent 2,012,443; and acylhydrazine-containing compounds combined with a thioamide ring or a heterocyclic group such as triazole and tetrazole, which work as adsorption groups such as those disclosed in U.S. Pat. Nos. 4,080,270 and 4,278,748 and British Patent 2,011,391B.

An internal latent image type emulsion in the photosensitive material of the present invention may be spectrally sensitized with a sensitizing dye for blue light of relatively long wavelength, green light, red light, or infrared light. As the sensitizing dye, cyanine dyes, merocyanine dyes, complex cyanine dyes, complex merocyanine dyes, holopolar cyanine dyes, styryl dyes, hemicyanine dyes, oxonol dyes, hemioxonol dyes, and the like, may be used. These sensitizing dyes include those cyanine dyes and merocyanine dyes disclosed in Japanese Patent Application (OPI) Nos. 40638/84, 40636/84 and 38739/84.

Various compounds may be included in the silver halide photographic emulsions of the present invention to prevent fogs from forming during a production process or a storage period of the photosensitive material, or when the photosensitive material is photography-processed, or when stabilizing the photographic performance of the photosensitive material. Such compounds include those compounds known as antifoggants and stabilizers. Specific compounds include azoles such as benzothiazolium salts, nitroindazoles, triazoles, benzotriazoles and benzimidazoles including those which are nitro- or halogen-substituted; heterocyclic mercapto compounds such as mercaptothiazoles, mercaptobenzothiazoles, mercaptobenzimidazoles, mercaptothiadiazoles, mercaptotetrazoles (e.g., 1-phenyl-5-mercaptotetrazole), and mercaptopyrimidines; the above-mentioned heterocyclic mercapto compounds having a water-soluble group such as a carboxyl group, a sulfone group, or the like; thioketo compounds such as oxazolinethione; azaindenes (e.g., tetraazaindenes such as 4-hydroxy-substituted (1,3,3a,7)-tetraazaindenes); benzenethiosulfonic acids; and benzenesulfinic acids.

A photographic emulsion layer or other hydrophilic colloid layers in photosensitive materials of the present invention may contain various surface active agents to assist coating, prevent electrification, improve sliding properties, and emulsification and dispersion, prevent adhesion, and improve photographic characteristics such as development acceleration, high contrast, and sensitization.

Examples of such surface active agents include those disclosed in *Research Disclosure,* Vol. 176, RD No. 7643, Item XI (December, 1978, pp. 26–27).

Various color couplers may be used in the present invention. Specific examples of these include those disclosed in those patents which are listed in *Research Disclosure,* RD No. 17643, Items VII-C to G. As dye-forming couplers, those couplers which provide the three primary colors (i.e., yellow, magenta and cyan) of the subtractive color process through color development are of importance. Specific examples of suitable nondiffusion, hydrophobic, 4-equivalent or 2-equivalent dye-forming couplers are disclosed in those patents listed in *Research Disclosure,* RD No. 17643, Items VII-C and VII-D. In addition to and besides these couplers, those described below can be used in the present invention.

Representative examples of yellow couplers which are suitable for use in the present invention include acylacetamide-containing couplers having a ballast group and of hydrophobic property. Specific examples of such couplers are disclosed in U.S. Pat. Nos. 2,407,210, 2,875,057 and 3,265,506. The use of a 2-equivalent yellow coupler in the present invention is preferred, and as a representative example of the yellow couplers, there are oxygen atom coupling-off type yellow couplers such as those disclosed in U.S. Pat. Nos. 3,408,194, 3,447,928, 3,933,501 and 4,022,620 and nitrogen atom coupling-off type yellow couplers such as those disclosed in Japanese Patent Publication No. 10739/83, U.S. Pat. Nos. 4,401,752 and 4,326,024, *Research Disclosure,* RD No. 18053 (April, 1979), British Patent 1,425,020, and West German Patent Application (OLS) Nos. 2,219,917, 2,261,361, 2,329,587 and 2,433,812. α-Pivaloylacetanilide-containing couplers have been found to have excellent fastness, and in particular, light fastness of its colored dye. α-Benzoylacetanilide-containing couplers may have a high coloring density.

Magenta couplers which are usable in the present invention include indazolone-containing or cyanoacetyl-containing, preferably 5-pyrazolone-containing and pyrazoloazole-containing, couplers which have a ballast group and are hydrophobic. 5-Pyrazolone-containing couplers having the 3-position substituted with an arylamino group or an acylamino group are preferred from the viewpoint of color tone or coloring density of colored dye. Representative examples of these are disclosed in U.S. Pat. Nos. 2,311,082, 2,343,703, 2,600,788, 2,908,573, 3,062,653, 3,152,896 and 3,936,015. As the coupling-off group of 2-equivalent 5-pyrazolone-containing couplers, nitrogen atom coupling-off groups such as those disclosed in U.S. Pat. No. 4,310,619 and arylthio groups such as those disclosed in U.S. Pat. No. 4,351,897 are particularly preferred. A 5-pyrazolone-containing coupler having a ballast group such as that disclosed in European Patent 73,636, may have high coloring density. As the pyrazoloazole-containing coupler, pyrazolobenzimidazoles such as those disclosed in U.S. Pat. No. 3,061,432, preferably pyrazolo[5,1-c][1,2,4]-triazoles such as those disclosed in U.S. Pat. No. 3,725,067, pyrazolotetrazoles such as those disclosed in *Research Disclosure,* RD No. 24220 (June, 1984) and Japanese Patent Application (OPI) No. 33552/85, and pyrazolopyrazoles such as those disclosed in *Research Disclosure,* RD No. 24230 (June, 1984) and Japanese Patent Application (OPI) No. 43659/85. With respect to slight yellow side-absorption of colored dye and excellent light fastness of the colored dye, imidazo[1,2-b]-pyrazoles such as those disclosed in U.S. Pat. No. 4,500,630 are preferred and pyrazolo[1,5-b][1,2,4]-triazole such as is disclosed in European Patent 119,860A is particularly preferred.

Cyan couplers which are usable in the present invention include nondiffusion, hydrophobic naphthol-containing couplers and phenol-containing couplers. Representative examples of these include naphthol-containing couplers such as those disclosed in U.S. Pat. No. 2,474,293, preferably oxygen atom coupling-off type 2-equivalent naphthol-containing couplers such as those disclosed in U.S. Pat. Nos. 4,052,212, 4,146,396, 4,228,233 and 4,296,200. Specific examples of the phenol-containing couplers are disclosed in U.S. Pat. Nos. 2,369,929, 2,801,171, 2,772,162 and 2,895,826.

Cyan couplers which are fast to humidity and temperatures are preferably used in the present invention. Representative examples of the cyan couplers include phenol-containing cyan couplers having an alkyl group higher than an ethyl group at the meta-position of the phenol nucleus, such as those disclosed in U.S. Pat. No. 3,772,002; 2,5-diacylamino-substituted phenol-containing couplers such as those disclosed in U.S. Pat. Nos. 2,772,162, 3,758,308, 4,126,396, 4,334,011 and 4,327,173, West German Patent Application (OLS) No. 3,329,729, and European Patent 121,365; and phenol-containing couplers having a phenyl ureido group at the 2-position of phenol nucleus and an acylamino group at the 5-position of the nucleus such as those disclosed in U.S. Pat. Nos. 3,446,622, 4,333,999, 4,451,559 and 4,427,767.

To compensate for the unnecessary absorption of colored dye, it is preferred to combine a colored coupler with a color negative photosensitive material for photographing, to conduct masking. As a typical example of such a colored coupler, there are those yellow-colored magenta couplers disclosed in U.S. Pat. No. 4,163,670 and Japanese Patent Publication No. 39413/82 and magenta-colored cyan couplers disclosed in U.S. Pat. Nos. 4,004,929 and 4,138,258, and British Patent 1,146,368. Other suitable colored couplers are disclosed in *Research Disclosure,* RD No. 17643, Item VII-G.

A coupler whose colored dye has appropriate diffusibility can be combined with a photosensitive material to improve graininess of the material. Specific examples of such couplers would include the magenta couplers disclosed in U.S. Pat. No. 4,366,237 and British Patent 2,125,570 and the yellow couplers, magenta couplers, and cyan couplers disclosed in European Patent 96,570, and West German Patent Application (OLS) No. 3,234,533.

Dye-forming couplers and the above-mentioned special couplers may form a polymer of a dimer or more.

Typical examples of dye-forming couplers converted into a polymer are disclosed in U.S. Pat. Nos. 3,451,820 and 4,080,211. Specific examples of magenta couplers converted into a polymer are disclosed in British Patent 2,102,173 and U.S. Pat. No. 4,367,282.

Couplers which release a photographically useful residual group with coupling preferably may also be used in the present invention. As couplers releasing a development inhibitor (i.e., DIR couplers), those couplers disclosed in the patents listed in *Research Disclosure,* RD. No. 17643, Item VII-F, are useful.

DIR couplers which may be combined with a photosensitive material of the present invention include developing solution deactivation-type couplers such as those disclosed in Japanese Patent Application (OPI) No. 151944/82; timing-type couplers such as those disclosed in U.S. Pat. No. 4,248,962 and Japanese Patent Application (OPI) No. 154234/82; and reaction-type couplers such as those disclosed in Japanese Patent Application (OPI) No. 184248/85. Particularly preferred are developing solution deactivation-type DIR couplers such as those disclosed in Japanese Patent Application (OPI) Nos. 151944/82, 217932/83, 218644/85, 225156/85, and 233650/85, and reaction-type DIR couplers such as those disclosed in Japanese Patent Application (OPI) No. 184248/85.

If the photosensitive material of the present invention is used for a color diffusion transfer process, a dye-developing agent may be used as a coloring material. Alternatively, a coloring material which is nondiffusible (i.e., immobile) in an alkaline medium (a developing solution) but releases a diffusible dye or its precursor as a result of its development may also be used. Examples of diffusible dye-releasing coloring materials include diffusible dye-releasing couplers and redox compounds. These are useful not only as a coloring material for a color diffusion transfer process (wet method) but, in addition, as a coloring material for heat-sensitive recording (dry method).

As DRR compounds used in the process, those disclosed in *Research Disclosure,* Vol. 176, RD No. 17643, Item XXIII, Columns D, E and F (December, 1978) may be used.

As the method, format, and the like, of a color diffusion transfer process and a silver salt diffusion transfer process, those disclosed in *Research Disclosure,* Vol. 176, RD No. 17643, Item XXIII, Columns A, B, C and G (December, 1978) and *Research Disclosure,* Vol. 151, RD No. 15162, pp. 75–87 (November, 1976) may be used.

Various material supports for photographs may be used for the photosensitive material of the present invention. A silver halide emulsion may be applied to one side or both sides of support. As suitable supports, those disclosed in *Research Disclosure,* Vol. 176, RD No. 17643, Item XVII (December, 1978) may be used.

The photosensitive material of the present invention may be development-processed by known developing methods. Such developing methods include those disclosed in *Research Disclosure,* Vol. 176, RD No. 17643, Items XIX to XXI (December, 1978), *Research Disclosure,* Vol. 151, RD No. 15162, p. 79, right column, line 30 to 80, left column, line 19 (November, 1976), and U.S. Pat. Nos. 4,224,401 and 4,168,977.

In black-and-white developing solutions, known developing agents such as dihydroxybenzenes such as hydroquinone, 3-pyrazolidones such as 1-phenyl-3-pyrazolidone, aminophenols such as N-methyl-p-aminophenol may be used in the form of a single compound or in a combination of two or more compounds.

A suitable color developing solution comprises, in general, an alkaline aqueous solution containing a color developing agent. As the color developing agent, known primary aromatic amine developing agents, for example, phenylenediamines such as 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfonamidoethylaniline, 4-amino-3-methyl-N-ethyl-N-β-methoxyethylaniline, may be used.

The developing solution may contain, in addition to a color developing agent, a pH buffering agent such as a sulfite, carbonate, borate or phosphate of alkali metal, a bromide, an iodide, a development inhibitor or an antifoggant such as an organic antifoggant, and the like. Furthermore, the developing solution may contain, as required, a hard water softener, a preservative such as hydroxylamine, an organic solvent such as benzyl alcohol or diethylene glycol, a development accelerator such as polyethylene glycol, a quaternary ammonium salt, amines, or the like, a fogging agent such as sodium boronhydride, an auxiliary developing agent such as 1-phenyl-3-pyrazolidone, a tackifier, a polycarboxylic acid-containing chelating agent such as that disclosed in U.S. Pat. No. 4,083,723, an antioxidizing agent as disclosed in West German Patent Application (OLS) No. 2,622,950, and the like. It is preferred that the developing solution contain substantially no benzyl alcohol to prevent environmental pollution, to simplify preparation of the developing solution, and to improve the storage stability of the developing solution.

When a color photographic processing is applied to a photographic material after being color development-processed, the material is usually bleaching-processed. The bleaching process may be carried out together with a fixing process or the processing may be carried out separately. Suitable bleaching agents include a compound of polyvalent metal such as iron(III) or cobalt(III), peroxides, quinones and nitroso compounds. Of these, potassium ferricyanide, iron(III) sodium ethylenediaminetetraacetate and iron(III) ammonium ethylenediaminetetraacetate are particularly useful. An iron(III) ethylenediaminetetraacetate complex salt is useful in an independent bleaching solution and also in a combined bleach-fixing solution.

In addition to a bleaching accelerator, various known additives may be added to a bleaching solution or bleach-fixing solution. As the bleaching accelerator, a compound having a mercapto group or a disulfide group is preferred because it has a large accelerating effect. In particular, those compounds disclosed in U.S. Pat. No. 3,893,858, West German Patent 1,290,812, and Japanese Patent Application (OPI) No. 95630/78 are preferred. In addition, a compound such as that disclosed in U.S. Pat. No. 4,552,835 is also preferred. These bleaching accelerators may be added directly to a photosensitive material. When a color photosensitive material for photographing is bleach-fixed, these bleach accelerators are particularly effective.

Examples of fixing agents include thiosulfates, thiocyanates, thioether-containing compounds, thioureas, and a large amount of iodide. A thiosulfate is generally used. As a preservative for a bleach-fixing solution or a fixing solution, a sulfite, a bisulfite, or a carbonylbisulfite adduct is preferred.

After a bleach-fixing process or a fixing process, a washing process and a stabilization process are usually carried out. In a washing process and a stabilization process, various known compounds may be added to prevent precipitation and to save water. These compounds include, as required, hard water softeners such as an inorganic phosphoric acid, an aminopolycarboxylic acid, an organic aminopolyphosphonic acid or an organic phosphoric acid to prevent precipitation; germicides or bactericides to prevent the formation of various bacteria or algae; metallic salts such as magnesium, aluminum, and bismuth salts; surface active agents to prevent drying load or the formation of a drying unevenness; and various hardening agents. Furthermore, those compounds disclosed in *Photographic Science and Engineering,* written by L. E. West, Vol. 6, pp. 344–359 (1965) may be added. It is particularly effective to add a chelating agent and a bactericide.

Water can be saved by countercurrent washing through 2 to 4 tanks in the washing process. Furthermore, as disclosed in Japanese Patent Application (OPI) No. 8543/82, a multistage countercurrent stabilization process may be carried out instead of a washing process. Such a stabilization process requires 2 to 9 tanks for the countercurrent bath, and to the stabilizing bath, in addition to the above-mentioned additives, various additives are added to stabilize the image. Representative examples of such additives include aldehydes such as formalin as well as various buffering agents for adjusting the pH value of film (e.g., to a pH value of 3 to 9) such as borates, metaborates, borax, phosphates, carbonates, potassium hydroxide, sodium hydroxide, ammonia water, monocarboxylic acids, dicarboxylic acids, and polycarboxylic acids which are used in the form of a combination of two or more compounds. Furthermore, various other additives may be used as required. These include chelating agents such as inorganic phosphoric acid, aminopolycarboxylic acid, organic phosphoric acid, organic phosphonic acid, aminopolyphosphonic acid and phosphonocarboxylic acid, germicides such as benzoisothiazolinone, isothiazolone, 4-thiazolinebenzimidazole, halogenated phenol, sulfanilamide and benzotriazole, surface active agents, fluorescent whitening agents and hardening agents. Compounds which are used for the same object or for different objects may also be used in the form of a combination of two or more compounds.

It is preferred to add an ammonium salt such as ammonium chloride, ammonium nitrate, ammonium sulfate, ammonium phosphate, ammonium sulfite, or ammonium thiosufate as an adjusting agent for the pH value of film after it has been processed.

With a color photosensitive material for photography, a process such as the washing stabilization which is usually carried out after fixing may be replaced by the above-described stabilization process and washing process (i.e., water saving treatment). In such a process, if a magenta coupler is a 2-equivalent coupler, formalin in the stabilizing bath may be removed.

Various processing solutions in the present invention may be used at 10° C. to 50° C. The standard processing temperature is 33° C. to 38° C. but this temperature may be raised to accelerate the process and reduce the processing time, or alternatively, the temperature may be lowered to improve image quality or stability of a processing solution.

The present invention will be described in further detail by reference to examples below. However, these examples are not intended to, in any way, limit the present invention.

EXAMPLE 1

An internal latent image type direct positive silver bromide emulsion having grains chemically sensitized with sulfur and gold on the inside and also chemically sensitized with sulfur on the surface was prepared by the same process set forth in Japanese Patent Application (OPI) No. 95533/85. The emulsion grains were octahedral grains having a diameter of 1.0 μm. The compound of the present invention was added to the emulsion or, for comparison, the compound disclosed in U.S. Pat. No. 3,759,901 was added to an emulsion. Each emulsion was then applied to a cellulose acetate film support at a coating weight of 4.4 g/m$^2$ of silver and at a coating weight of 4.9 g/m$^2$ of gelatin, together with a protective layer having a coating weight of 0.8 g/m$^2$ of gelatin. These coating samples were exposed for 1/10 second with tungsten light of 1,000 lux through a continuous gradation wedge. The samples were then treated with Developing Solution X (a surface developing solution, pH=13.5) having the following composition.

The maximum density (Dmax) and minimum density (Dmin) of the resulting direct reversal image are shown in Table 1.

| Developing Solution X: | |
|---|---|
| Sodium Sulfite | 30 g |
| Hydroquinone | 10 g |
| 1-Phenyl-4-methyl-4-hydroxymethyl-3-pyrazolidine | 0.75 g |
| Trisodium Phosphate | 40 g |
| Sodium Hydroxide | 10.7 g |
| 5-Methylbenzotriazole | 0.02 g |
| Water to make | 1 liter |

TABLE 1

| Nucleating Agent | Added Amount (mmol/mol Ag) | Dmax | Dmin | Remarks |
|---|---|---|---|---|
| None | — | 0.07 | 0.07 | Comparison |
| Compound (1) | 0.004 | 1.85 | 0.07 | Invention |
| Compound (11) | 0.004 | 1.90 | 0.08 | Invention |
| Compound (20) | 0.004 | 1.72 | 0.08 | Invention |
| Compound A | 0.4 | 1.25 | 0.07 | Comparison |

Comparative Compound A:

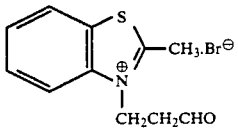

From the results shown in Table 1, it can be seen that less nucleating agent is necessary when the compound of the present invention is used. Also, the emulsion containing the compound of the present invention shows better reversal performance than the emulsion containing the comparative compound.

EXAMPLE 2

Emulsions containing the compound of the present invention and comparative compounds as set forth in Table 2 were prepared. The emulsions were the same internal latent image type direct positive emulsion used in Example 1 and the samples were prepared in the same manner as the coating samples of Example 1. These coating samples were image-exposed under the same exposure condition as in Example 1, and then were processed with Developing Solution Y (pH=10.7) of the following composition having a pH value lower than that of Developing Solution X. The maximum density (Dmax) and minimum density (Dmin) of the resulting reversal image are shown in Table 2.

| Developing Solution Y: | |
|---|---|
| Sodium Sulfite | 30 g |
| Hydroquinone | 10 g |
| 1-Phenyl-4-methyl-4-hydroxymethyl-3-pyrazolidine | 0.75 g |
| Trisodium Phosphate | 40 g |
| 5-Methylbenzotriazole | 0.02 g |
| Water to make | 1 liter |

From the results shown in Table 2, it can be seen that less nucleating agent is necessary with the compounds of the present invention to achieve good reversal properties even at a low pH value.

TABLE 2

| Nucleating Agent | Added Amount (mmol/mol Ag) | Dmax | Dmin | Remarks |
|---|---|---|---|---|
| None | — | 0.04 | 0.04 | Comparison |
| Compound (4) | 0.095 | 1.92 | 0.05 | Invention |
| Compound (8) | 0.095 | 1.85 | 0.04 | Invention |
| Compound (11) | 0.095 | 2.05 | 0.05 | Invention |
| Compound (20) | 0.095 | 1.95 | 0.04 | Invention |
| Compound A | 1.0 | 1.54 | 0.04 | Comparison |
| Compound B | 1.0 | 1.75 | 0.05 | Comparison |
| Compound C | 1.0 | 1.72 | 0.04 | Comparison |

Comparative Compound A (U.S. Pat. No. 3,759,901):

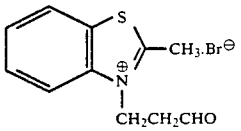

Comparative Compound B (U.S. Pat. No. 3,759,901):

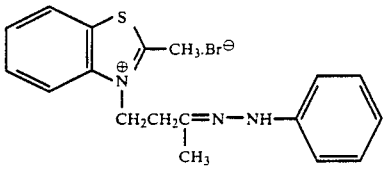

Comparative Compound C (U.S. Pat. No. 3,719,494):

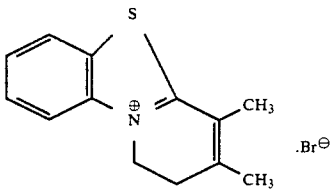

EXAMPLE 3

Each layer was applied to a transparent polyethylene terephthalate support in the order set forth below to prepare four types of color direct positive Photosensitive Material Sheets (A) to (D).

(1) A mordant layer containing the following copolymer (3.0 g/m²) and gelatin (3.0 g/m²)

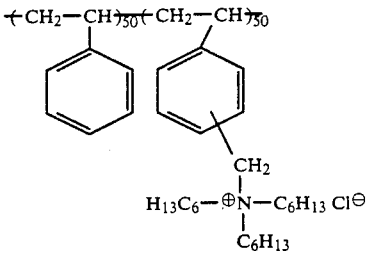

(2) A white reflecting layer containing titanium oxide (18 g/m²) and gelatin (2.0 g/m²).

(3) A light-screening layer containing carbon black (2.0 g/m²) and gelatin (1.0 g/m²).

(4) A layer containing a magenta DRR compound (0.21 g/m²) having the following constitutional formula I, a magenta DRR compound (0.11 g/m²) having the following constitutional formula II, tricyclohexyl phosphate (0.08 g/m²) 2,5-di-tert-pentadecylhydroquinone (0.009 g/m²), and gelatin (0.9 g/m²).

Constitutional For

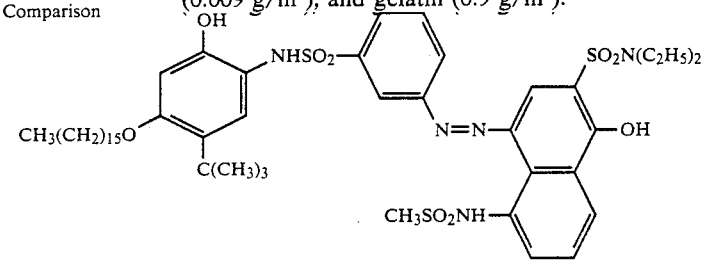

Constitutional Formula II:

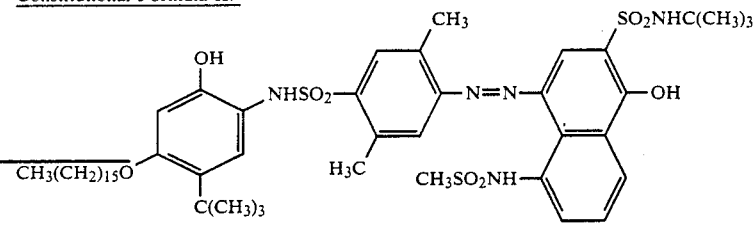

(5) A green-sensitive emulsion layer containing a dye-sensitized internal latent image type direct positive silver bromide emulsion (0.82 g/m² in a silver amount wherein a silver content is about 0.06 g per g-emulsion), gelatin (0.9 g/m²), sodium-2-sulfonate-5-n-pentadecylhydroquinone (0.08 g/m²), and with the exception of Material Sheet (A), a different nucleating agent ($10^{-10}$ mol to $10^{-9}$ mol per g of emulsion) of the present invention on each photosensitive material sheet.

(6) A protective layer containing gelatin (1.0 g/m²).

The above-mentioned Photosensitive Sheets (A) to (D) were exposed and developed under the conditions of the combination of a processing element and a cover sheet as set forth below.

Processing Element

| Processing Solution: | |
|---|---|
| 1-Phenyl-4-methyl-4-hydroxymethyl-3-pyrazolidone | 8.0 g |
| tert-Butylhydroquinone | 0.1 g |
| 5-Methylbenzotriazole | 2.5 g |
| Benzyl Alcohol | 1.5 ml |
| Sodium Sulfite (anhydrous) | 1.5 g |
| Sodium Salt of Carboxymethyl Cellulose | 61 g |
| Zinc Nitrate Hexahydrate | 0.4 g |
| Carbon Black | 410 g |
| Potassium Hydroxide | 56 g |
| $H_2O$ | 260 ml |

Each 0.8 g of the processing solution having the above-mentioned composition was filled into "a container capable of being broken by pressure".

Cover Sheet

A polyacrylic acid in the form of an aqueous 10% solution having a viscosity of about 1,000 cp (15 g/m²) as an acid polymer layer (neutralizing layer) was coated on a polyethylene terephthalate support. Then, acetylcellulose (3.8 g/m²) and a copolymer of styrene and maleic anhydride having a molar ratio of the styrene to the maleic anhydride of about 60/40 and a molecular weight of about 50,000 (0.2 g/m²) were applied, as a neutralization timing layer, to the acid polymer layer to prepare a cover sheet.

Processing Step

The cover sheet was laid on the top of the photosensitive sheet and the photosensitive sheet was wedge-exposed for 1/100 second with a tungsten light source from the cover sheet side. Then, the processing solution was developed between both sheets with a pressure roller to have a thickness of 100 μm of the processing solution layer. The development processing was conducted at 25° C. One hour after the processing, the green density of the image formed on the image-receiving layer was measured with a Macbeth reflection densitometer through the transparent support of the photosensitive sheet. The results are shown in Table 3.

From the results in Table 3, it can be seen that the nucleating agents of the present invention show good reversal properties even in a color direct positive photosensitive material.

TABLE 3

| Photosensitive Material | Nucleating Agent | Added Amount (mmol/g, emulsion) | Dmax | Dmin | Remarks |
|---|---|---|---|---|---|
| (A) | None | — | 0.05 | 0.05 | Comparison |
| (B) | Compound (1) | $5.0 \times 10^{-6}$ | 2.12 | 0.06 | Invention |
| (C) | Compound (11) | $5.0 \times 10^{-6}$ | 2.15 | 0.07 | Invention |
| (D) | Compound (20) | $5.0 \times 10^{-6}$ | 2.05 | 0.07 | Invention |

EXAMPLE 4

An emulsion was prepared by adding Sensitizing Dye E ($9.5 \times 10^{-5}$ mol) and the compound of the present invention or Comparative Compound A to 1 kg of a silver bromide emulsion (having a (100) face). The silver content was about 63 g per kg-emulsion. The resulting emulsion was coated on a triacetate film support and dried to obtain a photographic material.

The photographic material was exposed by optical wedge for 0.1 second at an illuminance of 3,200 lux through a yellow filter (SC-46, a product of Fuji Photo Film Co., Ltd.) disposed against a light source.

The material was then developed at 20° C. for 5 minutes with a developing solution having the following composition, and then the material was stopped, fixed, and washed. Thus, a strip having a prescribed black-and-white image was obtained. The strip was measured for a density with a TCD type densitometer (a product of Fuji Photo Film Co., Ltd.) to determine a yellow filter sensitivity ($S_\gamma$) and fog value. The results obtained by taking a reference point of optical density to determine sensitivity as (fog+0.10) are shown as a relative value in Table 4.

| Composition of Developing Solution: | |
|---|---|
| Water | 500 ml |
| Metol | 2 g |
| Sodium Sulfite (anhydrous) | 90 g |
| Hydroquinone | 8 g |
| Sodium Carbonate (monohydrate) | 52.5 g |
| Potassium Bromide | 5 g |
| Water to make | 1 liter |

From comparison of sensitivity values in Table 4, it can be seen that compounds of the present invention have a high photographic sensitivity compared to that of Comparative Compound A.

TABLE 4

| Nucleating Agent | Added Amount (mmol/kg, emulsion) | Relative Sensitivity | Fog Density | Remarks |
|---|---|---|---|---|
| None | — | 100 (standard) | 0.04 | Comparison |
| Compound (1) | $4.0 \times 10^{-3}$ | 145 | 0.04 | Invention |
| Compound (11) | $4.0 \times 10^{-3}$ | 154 | 0.04 | Invention |

TABLE 4-continued

| Nucleating Agent | Added Amount (mmol/kg, emulsion) | Relative Sensitivity | Fog Density | Remarks |
|---|---|---|---|---|
| Compound A | $2.0 \times 10^{-1}$ | 125 | 0.04 | Comparison |

Sensitizing Dye E:

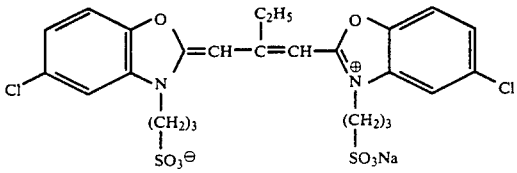

Comparative Compound A:

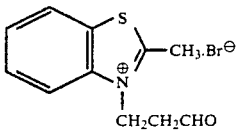

EXAMPLE 5

An aqueous solution of potassium bromide and an aqueous solution of silver nitrate were simultaneously added slowly to an aqueous solution of gelatin under violent stirring at 75° C. for a period of about 40 minutes. A monodispersed silver bromide emulsion containing octahedral grains having an average grain diameter of 0.4 μm was obtained. 4 mg of each of sodium thiosulfate and chloroauric acid (tetrahydrate) per mol of silver was added to the emulsion and the mixture was heated at 75° C. for 80 minutes to chemically sensitize the emulsion. The silver bromide grains which were obtained were used as core grains and were grown by further treatment for 40 minutes under the same precipitation circumstances as in the first silver bromide precipitation process. A monodispersed core/shell silver bromide emulsion containing octahedral grains having an average grain diameter of 0.6 μm was then obtained. After being washed and desalted, 0.9 mg of sodium thiosulfate per mol of silver was added to the emulsion. Then, the emulsion was heated at 65° C. for 60 minutes to chemically sensitize it. Thus, an internal latent image type Silver Halide Emulsion B was obtained.

Multilayer color photographic paper having layer constitution as shown in Table 5 on a paper support laminated with polyethylene on both sides was prepared by using Emulsion B. Coating solutions were prepared as follows.

In preparing the first layer coating solution, 10 g of yellow coupler (a) and 2.3 g of a dye stabilizer (b) were dissolved by adding 10 ml of ethyl acetate and 4 ml of a solvent (c), and the solution was emulsified and dispersed in 90 ml of an aqueous 10% gelatin solution containing 5 ml of an aqueous 10% sodium dodecylbenzenesulfonate solution. To Silver Bromide Emulsion B (containing 70 g of Ag per kg of emulsion) $2.0 \times 10^{-4}$ mol of a blue-sensitive dye as set forth below, per mol of silver bromide was added to prepare 90 g of a blue-sensitive emulsion. The emulsified dispersion and the blue-sensitive emulsion were mixed to prepare a uniform dispersion, to which a gelatin solution was added to adjust the concentration of components and to obtain the composition having a layer as shown in Table 5. $2 \times 10^{-4}$ mol of a nucleating agent per mol of Ag was then added. Thus, a coating solution for the first layer was prepared.

Coating solutions for the second layer to the seventh layer were prepared by a method similar to that for the first layer coating solution. As a hardening agent for gelatin of each layer, a sodium salt of 1-oxy-3,5-dichloro-s-triazine was used.

TABLE 5

| | |
|---|---|
| Seventh Layer: Protective Layer | |
| Gelatin | 1.33 g/m² |
| Acryl-modified copolymer of polyvinyl alcohol (modification degree: 17%) | 0.17 g/m² |
| Sixth Layer: Ultraviolet Absorbing Layer | |
| Gelatin | 0.54 g/m² |
| Ultraviolet absorbing agent (h) | $5.10 \times 10^{-4}$ mol/m² |
| Solvent (j) | 0.08 g/m² |
| Fifth Layer: Red-Sensitive Layer | |
| Silver Bromide Emulsion B | 0.22 g/m² (as Ag) |
| Gelatin | 0.90 g/m² |
| Cyan coupler (k) | $7.05 \times 10^{-4}$ mol/m² |
| Dye stabilizer (l) | $5.20 \times 10^{-4}$ mol/m² |
| Solvent (m) | 0.22 g/m² |
| Nucleating agent (n) | $4.1 \times 10^{-7}$ mol/m² |
| Nucleation promoting agent (o) | $6.4 \times 10^{-5}$ mol/m² |
| Fourth Layer: Ultraviolet Absorbing Layer | |
| Gelatin | 1.60 g/m² |
| Ultraviolet absorbing agent (h) | $1.70 \times 10^{-4}$ mol/m² |
| Color stain preventing agent (i) | $1.60 \times 10^{-4}$ mol/m² |
| Solvent (j) | 0.24 g/m² |
| Third Layer: Green-Sensitive Layer | |
| Silver Bromide Emulsion B | 0.27 g/m² (as Ag) |
| Gelatin | 1.56 g/m² |
| Magenta coupler (e) | $4.6 \times 10^{-4}$ mol/m² |
| Dye stabilizer (f) | 0.14 g/m² |
| Solvent (g) | 0.42 g/m² |
| Nucleating agent (n) | $5.0 \times 10^{-7}$ mol/m² |
| Nucleation promoting agent (o) | $6.4 \times 10^{-5}$ mol/m² |
| Second Layer: Color Stain Preventing Layer | |
| Gelatin | 0.90 g/m² |
| Color stain preventing agent (d) | $2.33 \times 10^{-4}$ mol/m² |
| First Layer: Blue-Sensitive Layer | |
| Silver Bromide Emulsion B | 0.35 g/m² (as Ag) |
| Gelatin | 1.35 g/m² |
| Yellow coupler (a) | $6.91 \times 10^{-4}$ mol/m² |
| Dye stabilizer (b) | 0.13 g/m² |
| Solvent (c) | 0.2 g/m² |
| Nucleating agent (n) | $6.5 \times 10^{-7}$ mol/m² |
| Nucleation promiting agent (o) | $6.4 \times 10^{-5}$ mol/m² |

Support

Polyethylene laminate paper (containing white pigments (such as $TiO_2$) and a bluish dye (such as ultramarine blue) in a polyethylene layer in the side of the first layer)

As the spectral sensitizing agent of each emulsion, the following were used.

Blue-Sensitive Emulsion Layer:

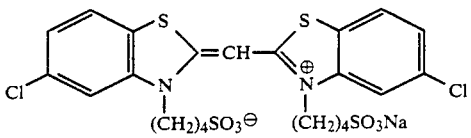

-continued (Added amount: $2 \times 10^{-4}$ mol/mol-Ag)

Green-Sensitive Emulsion Layer:

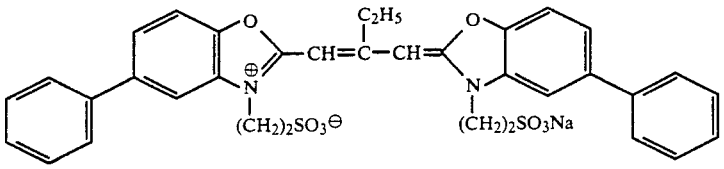

(Added amount: $3 \times 10^{-4}$ mol/mol-Ag)

Red-Sensitive Emulsion Layer:

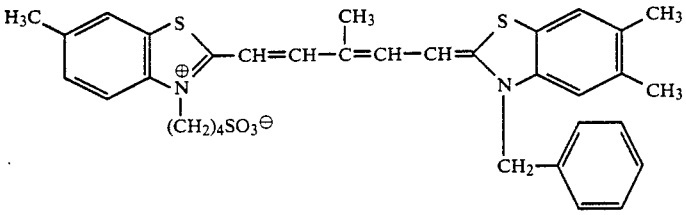

(Added amount: $1 \times 10^{-4}$ mol/mol-Ag)

As the irradiation preventing dye of each emulsion layer, the following dyes were used.

Green-Sensitive Emulsion Layer:

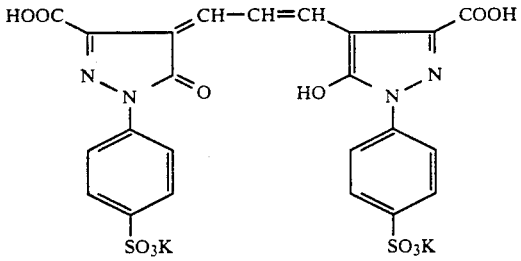

(Added amount: $3.5 \times 10^{-4}$ g/m$^2$)

Red-Sensitive Emulsion Layer:

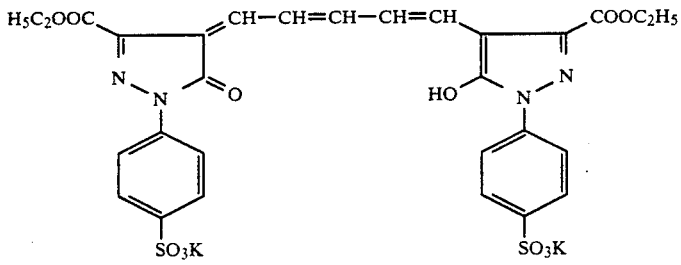

(Added amount: $3.5 \times 10^{-4}$ g/m$^2$)

Constitutional formulae of compounds such as couplers used in the examples are as follows.

(a) Yellow Coupler:

-continued
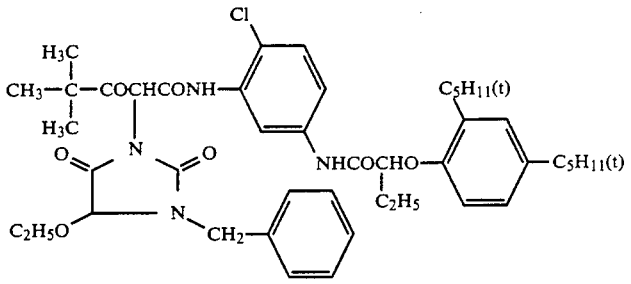
(b) Dye Stabilizer:
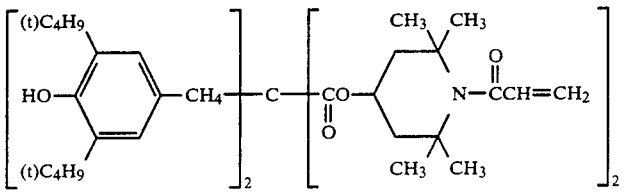
(c) Solvent:
(iso-$C_9H_{19}O$)$_3$P=O
(d) Color Stain Preventing Agent:
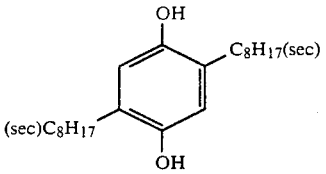
(e) Magenta Coupler:
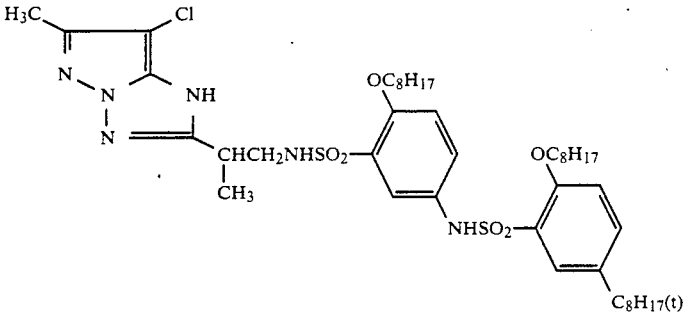
(f) Dye Stabilizer:
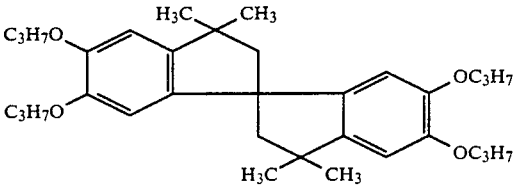
(g) Solvent:
A mixture of [(n)$C_8H_{17}O$)$_3$P=O
and
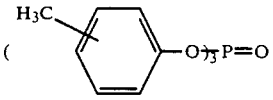
at a mixing ratio by weight of 2/1
(h) Ultraviolet Absorbing Agent:

-continued
A mixture of
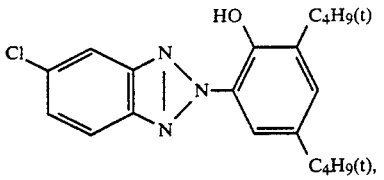
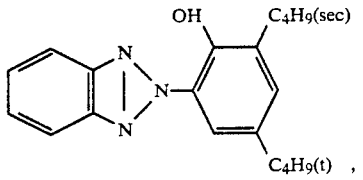
and
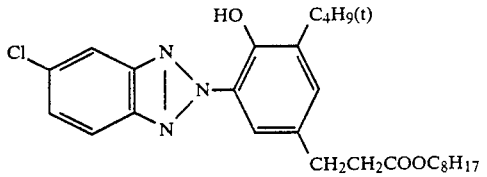
at a molar ratio of 1/5/3
(i) Color Stain Preventing Agent:
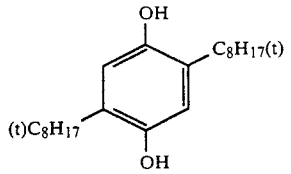
(j) Solvent:
$(iso\text{-}C_9H_{19}O)_3P{=}O$
(k) Cyan Coupler:
a mixture of
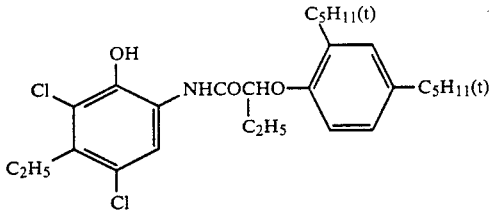
and
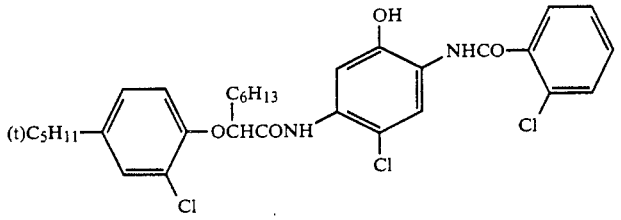
at a molar ratio of 1/1
(l) Dye Stabilizer:
A mixture of -continued

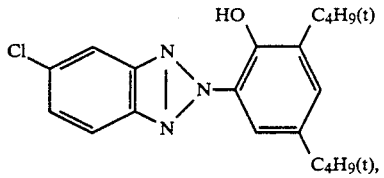

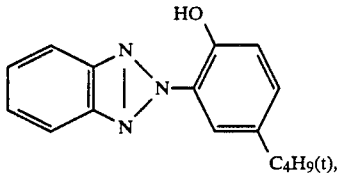

and

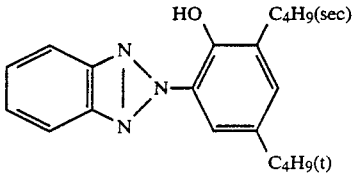

at a molar ratio of 1/3/3

(m) Solvent:

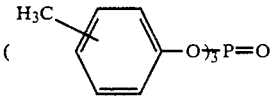

(n) Nucleating Agent (a comparative compound as disclosed in U.S. Pat. No. 3,759,901):

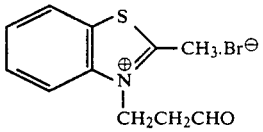

(o) Nucleation Promoting Agent:

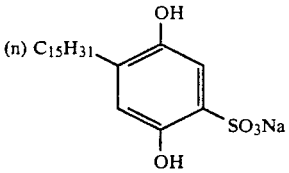

After the balance between the surface tension and viscosity was adjusted in the coating solutions of the first layer to the seventh layer, they were coated on a support at the same time to prepare a multilayer silver halide color photographic material. The photosensitive material was taken as Sample 501.

Next, photosensitive material Samples 502 to 504 were prepared by the same method as in Sample 501 except that the nucleating agent (n) was substituted with a nucleating agent of the present invention. After gradation exposure for sensitometry was applied to these samples with an enlarging apparatus (Fuji Color Head 609, a product of Fuji Photo Film Co., Ltd.), they were development-processed by the following processing step.

| Processing Step | Temperature (°C.) | Time (min) |
|---|---|---|
| Developing Solution | 33 | 3.5 |
| Bleach-Fixing Solution | 33 | 1.5 |
| Washing | 28–35 | 3.0 |

Developing Solution:

| | |
|---|---|
| Trisodium Nitrilotriacetate | 2.0 g |
| Benzyl Alcohol | 15 ml |
| Diethylene Glycol | 10 ml |
| $Na_2SO_3$ | 2.0 g |
| KBr | 0.5 g |
| Hydroxylamine Sulfate | 3.0 g |
| 4-Amino-3-methyl-N-ethyl-N-[β-(methanesulfonamido)ethyl]-p-phenylenediamine Sulfate | 5.0 g |
| $Na_2CO_3$ (monohydrate) | 30 g |
| Water to make | 1 liter |
| | pH 10.1 |

Bleach-Fixing Solution:

| | |
|---|---|
| Ammonium Thiosulfate (70 wt %) | 150 ml |
| $Na_2SO_3$ | 15 g |
| $NH_4[Fe(EDTA)]$ | 55 g |
| EDTA · 2Na | 4 g |

-continued

| | |
|---|---|
| Water to make | 1 liter<br>pH 6.9 |

The results are shown in Table 6.

From Table 6, it can be seen that a multilayer color direct positive photosensitive materials containing the nucleating agents of the present invention at low concentrations show good reversal properties.

TABLE 6

| Sample No. | Nucleating Agent | Layer with an Addition of the Agent | Added Amount (mol/m$^2$) | Dmax | Dmin | Remarks |
|---|---|---|---|---|---|---|
| 501 | Comparative Compound (n) | Red-sensitive layer | $4.1 \times 10^{-7}$ | 1.75 | 0.30 | Comparison |
| | | Green-sensitive layer | $5.0 \times 10^{-7}$ | 1.91 | 0.20 | |
| | | Blue-sensitive layer | $6.5 \times 10^{-7}$ | 1.52 | 0.25 | |
| 502 | Compound (4) | Red-sensitive layer | $8.2 \times 10^{-9}$ | 2.35 | 0.25 | Invention |
| | | Green-sensitive layer | $1.0 \times 10^{-8}$ | 2.51 | 0.18 | |
| | | Blue-sensitive layer | $1.3 \times 10^{-8}$ | 2.20 | 0.20 | |
| 503 | Compound (11) | Red-sensitive layer | $8.2 \times 10^{-9}$ | 2.50 | 0.20 | Invention |
| | | Green-sensitive layer | $1.0 \times 10^{-8}$ | 2.73 | 0.15 | |
| | | Blue-sensitive layer | $1.3 \times 10^{-8}$ | 2.30 | 0.18 | |
| 504 | Compound (20) | Red-sensitive layer | $8.2 \times 10^{-9}$ | 2.20 | 0.25 | Invention |
| | | Green-sensitive layer | $1.0 \times 10^{-8}$ | 2.41 | 0.15 | |
| | | Blue-sensitive layer | $1.3 \times 10^{-8}$ | 2.12 | 0.20 | |

EXAMPLE 6

Core/shell type Emulsions I, II, and III were prepared by the processes set forth below.

Emulsion I

An aqueous solution of potassium bromide and an aqueous solution of silver nitrate were added simultaneously to an aqueous gelatin solution under violent stirring at 40° C. while controlling a pAg value at 7.90 for a period of about 20 minutes. A monodispersed silver bromide emulsion containing grains having an average grain size of 0.08 μm was obtained. To the emulsion, 580 mg each of sodium thiosulfate and chloroauric acid (tetrahydrate) per mol of Ag was added and the mixture was heated at 75° C. for 80 minutes to chemically sensitize the emulsion. The silver bromide grain emulsion which was obtained was used as core grains and the grains were grown under the same silver bromide precipitation circumstances as in the first precipitation process. Thus, a core/shell type monodispersed cubic silver bromide grain emulsion having an average grain size of 0.18 μm was obtained. After being washed and desalted, 6.2 mg of each of sodium thiosulfate and chloroauric acid (tetrahydrate) per mol of Ag was added to the emulsion. The mixture was then heated at 65° C. for 60 minutes to chemically sensitize the emulsion. Thus, Emulsion I was obtained.

Emulsion II

An aqueous solution of potassium bromide and an aqueous solution of silver nitrate were added simultaneously to an aqueous gelatin solution under violent stirring at 45° C. while controlling a pAg value at 9.70 for a period of about 40 minutes. An octahedral silver bromide grain emulsion having an average grain size of 0.2 μm was obtained. To the emulsion, 5 mg each of sodium thiosulfate and chloroauric acid (tetrahydrate) per mol of Ag was added and the mixture was heated at 75° C. for 80 minutes to chemically sensitize the emulsion. The silver bromide grains which were obtained were used as core grains and were further grown by processing them for 40 minutes under the same silver bromide precipitation circumstances as in the first precipitation process. Thus, a core/shell type monodispersed octahedral silver bromide grain emulsion having an average grain size of 0.35 μm was obtained. To the emulsion, 4.5 mg each of sodium thiosulfate and chloroauric acid (tetrahydrate) per mol of Ag was added and the mixture was heated at 65° C. for 60 minutes to chemically sensitize the emulsion. Thus, an internal latent image type silver halide Emulsion II was obtained.

Emulsion III

An aqueous solution of potassium-bromide and an aqueous solution of silver nitrate were added simultaneously to an aqueous gelatin solution under violent stirring at 75° C. while controlling a pAg value at 8.60 for a period of about 40 minutes. A monodispersed octahedral silver bromide grain emulsion having an average grain size of about 0.4 μm was obtained. To the emulsion, 4 mg each of sodium thiosulfate and chloroauric acid (tetrahydrate) per mol of Ag was added, and the mixture was heated at 75° C. for 80 minutes to chemically sensitize the emulsion. The silver bromide grains which were obtained were used as core grains and were further grown by processing them for 40 minutes under the same silver bromide precipitation circumstances as in the first precipitation process. Thus, a core/shell type monodispersed octahedral silver bromide grain emulsion having an average grain size of 0.6 μm was obtained. After being washed and desalted, 0.9 mg of sodium thiosulfate per mol of Ag was added to the emulsion. The mixture was then heated at 65° C. for 60 minutes to chemically sensitize the emulsion. Thus, an internal latent image type silver halide Emulsion III was obtained.

To an undercoated polyethylene terephthalate support having a thickness of 100 μm, an antihalation layer containing gelatin and Halation Preventing Dyes A, B and C at coating weights of 5 g/m$^2$, 65 mg/m$^2$, 80 mg/m$^2$, and 40 mg/m$^2$, respectively, was applied. A protective layer (upper layer) consisting of 30 mg/m$^2$ of a matting agent comprising barium strontium sulfate of average particle size of 1.0 μm (0.1 g/m$^2$), polymethyl methacrylate of average particle size of 1.3 μm (0.07 g/m$^2$), and Coating Aid D, 1 mg/m$^2$ of Electrification Controller E, 100 mg/m$^2$ of Hardening Agent F, and 1 g/m$^2$ of gelatin was then applied to the antihalation layer. Thus, a backing layer comprising the two layers was completed.

Dye A:

-continued

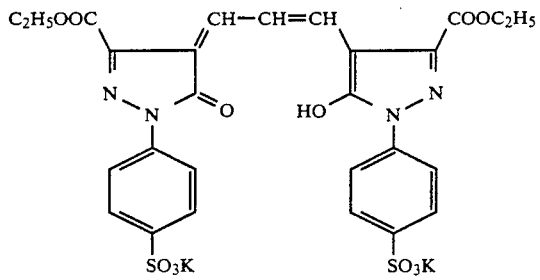

Dye B:

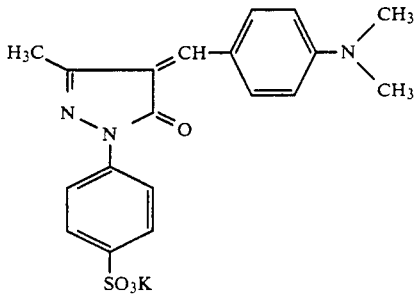

Dye C:

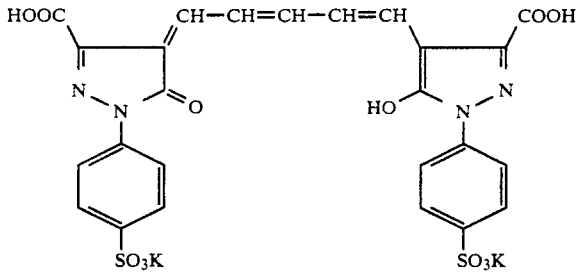

Coating Aid D:

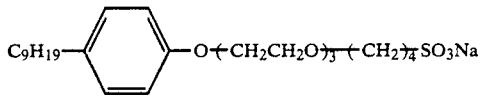

Electrification Controller E:

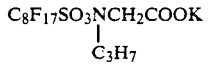

(Megafac F-120, a product of Dainippon Ink and Chemicals, Inc.)

Hardening Agent F:

-continued

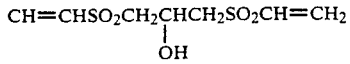

150 mg, 200 mg, and 180 mg of Sensitizing Dye G per mol of silver were added to the core/shell type Emulsions I, II, and III, respectively. Subsequently, a nucleating agent was added to each of the above-mentioned Emulsions I, II and III in the amounts shown in Table 7. Then, sodium dodecylbenzenesulfonate as a coating aid and a thickener were added to each of the emulsions to balance the surface tension and viscosity in the emulsions. Thus, coating solutions for the first, second, and third layers were prepared.

Sensitising Dye G:

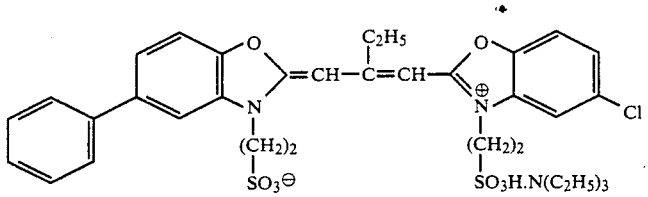

A coating solution for a protective layer as the fourth layer was prepared by adding Electrification Controller E, sodium dodecylbenzenesulfonate as a coating aid, and a thickener to an aqueous gelatin solution.

The coating solutions for the first, second, third, and fourth layers were coated on the support in a side opposite to the above-mentioned backing layer one over another in order from the first layer to the fourth layer so that coating weights of Ag were 1 g/m$^2$, 0.8 g/m$^2$, and 1.5 g/m$^2$ in the first layer, second layer, and third layer, respectively, and coating weights of gelatin were 1.3 g/m$^2$, 1.3 g/m$^2$, 2.4 g/m$^2$, and 1.7 g/m$^2$ in the first, second, third, and fourth layers, respectively. Thus, direct positive photographic materials (Samples 601 to 604) were prepared.

These samples were exposed for 1 second through a step wedge with a 1 kw tungsten lamp having a color temperature of 2,854° K. Then, they were developed at 36° C. for 1 minute with Developing Solution D prepared by mixing 1.0 liter of Replenishing Solution- A with 20 ml of Starter B in an automatic developing machine (FMCP-4800 type camera processor, a product of Fuji Photo Film Co., Ltd.). Subsequently, they were stopped, fixed and washed, and then were dried. The maximum density (Dmax) and minimum density (Dmin) of each sample were measured and the results are shown in Table 7.

| | | |
|---|---|---|
| Replenishing Solution A: | | |
| Sodium Sulfite | 100 | g |
| Potassium Carbonate | 20 | g |
| 1-Phenyl-4-methyl-4-hydroxymethyl-3-pyrazolidone | 3 | g |
| Hydroquinone | 45 | g |
| 5-Methylbenzotriazole | 40 | mg |
| Water to make | 1 | liter |
| The pH value was adjusted to 11.8 with potassium hydroxide. | | |
| Starter B: | | |
| Sodium Bromide | 175 | g |
| Glacial Acetic Acid | 63 | ml |
| Water to make | 1 | liter |

As shown in Table 7, the photosensitive material containing nucleating agents of the present invention show better reversal properties than those of the comparative sample even through the concentration of nucleating agent of the present invention was less than the concentration of nucleating agent in the comparative sample.

TABLE 7

| Sample No. | Nucleating Agent | Added Amount (mol/mol Ag) | Dmax | Dmin | Remarks |
|---|---|---|---|---|---|
| 601 | Nucleating Agent H | $2.0 \times 10^{-4}$ | 2.80 | 0.25 | Comparison |
| 602 | Compound (4) | $0.5 \times 10^{-4}$ | 3.05 | 0.20 | Invention |
| 603 | Compound (11) | $0.2 \times 10^{-4}$ | 3.25 | 0.17 | Invention |
| 604 | Compound (20) | $0.5 \times 10^{-4}$ | 2.85 | 0.15 | Invention |

Nucleating Agent H (as disclosed in U.S. Pat. No. 3,759,901, a comparative compound):

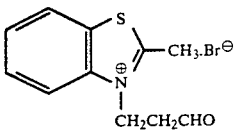

While the invention has been described in detail and with reference to specific embodiments thereof, it will be apparent to one skilled in the art that various changes and modifications can be made therein without departing from the spirit and scope thereof.

What is claimed is:

1. A silver halide photographic material which comprises a support having provided thereon at least one light-sensitive silver halide emulsion layer, the silver halide emulsion layer or at least one other hydrophilic colloid layer of said material containing at least one heterocyclic quaternary ammonium salt compound containing a group X that enhances adsorption of silver halide, said compound selected from those represented by the following general formulae:

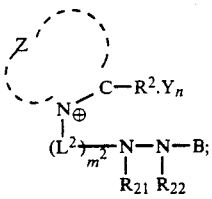

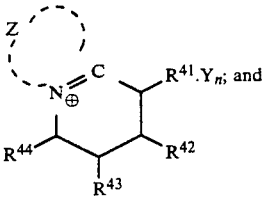

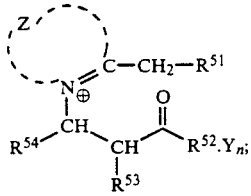

wherein z represents non-metallic atoms necessary for forming a 5- or 6- membered heterocyclic ring; Y represents a charge-balancing counter-ion; n represents 0 to 1; $R^2$ represents a hydrogen atom, an aliphatic group, or an aromatic group; $L^2$ represents a divalent linkage group; $m^2$ represents 0 or 1; $R^{21}$ and $R^{22}$ both represent hydrogen atoms or one of them represents a hydrogen atom and the other represents a substituted or unsubstituted alkylsulfonyl group, a substituted or unsubstituted arylsulfonyl group, or a substituted or unsubstituted acyl group; B represents a formyl, acyl, arylsulfonyl, alkylsulfonyl, arylsulfinyl, carbomoyl, alkoxycarbonyl, aryloxycarbonyl, sulfinanoyl, alkoxysulfonyl, thioacyl, thiocarbamoyl, sulfanoyl, heterocyclic, aliphatic, or aromatic group; $R^{41}$, $R^{42}$, $R^{43}$, and $R^{44}$, which may be the same or different, are selected from aliphatic groups, hydrogen, and aromatic groups; $R^{52}$ represents hydrogen, alkyl, aryl or araalkyl groups; and $R^{51}$, $R^{53}$, and $R^{54}$, which may be the same or different, are selected from aliphatic groups, hydrogen, and aromatic groups.

2. A silver halide photographic material according to claim 1, wherein said heterocyclic quaternary ammonium salt compound is represented by said formula;

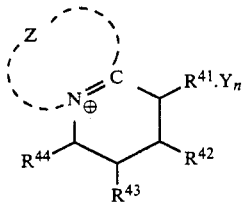

3. The silver halide photographic material as claimed in claim 1, wherein said at least one heterocyclic quaternary ammonium salt compound is contained in the silver halide emulsion layer.

4. The silver halide photographic material as claimed in claim 3, wherein said at least one heterocyclic quaternary ammonium salt compound is present in an amount of about $1 \times 10^{-7}$ mol to about $1 \times 10^{-2}$ mol per mol of silver in the silver halide emulsion layer.

5. The silver halide photographic material as claimed in claim 4, wherein said at least one heterocyclic quaternary ammonium salt compound is present in an amount of about $1 \times 10^{-6}$ mol to about $1 \times 10^{-3}$ mol per mol of silver in the emulsion layer.

6. The silver halide photographic material as claimed in claim 3, wherein said silver halide emulsion layer is an internal latent image silver halide photographic emulsion layer.

7. The silver halide photographic material as claimed in claim 6, wherein said at least one heterocyclic quaternary ammonium salt compound is present in an amount of about $1 \times 10^{-5}$ mol to about $1 \times 10^{-3}$ mol per mol of silver in the emulsion layer.

8. The silver halide photographic material as claimed in claim 3, wherein said silver halide emulsion layer is a surface latent image silver halide photographic emulsion layer.

9. The silver halide photographic material as claimed in claim 8, wherein said at least one heterocyclic quaternary ammonium salt is present in an amount of about $1 \times 10^{-5}$ mol to about $1 \times 10^{-3}$ mol per mol of silver in the emulsion layer.

10. The silver halide photographic material as claimed in claim 1, wherein X is selected from at least one of a thioamide group, a mercapto group, a 5-membered nitrogen-containing heterocyclic group or a 6-membered nitrogen-containing heterocyclic group.

11. The silver halide photographic material as claimed in claim 1, wherein said silver halide emulsion layer includes at least one of silver bromide, silver iodide, silver chloride, silver chlorobromide, silver bromoiodide, or silver chlorobromoiodide.

12. The silver halide photographic material as claimed in claim 11, wherein said silver halide emulsion layer includes silver bromoiodide containing not more than about 15 mol% silver iodide.

13. The silver halide photographic material as claimed in claim 11, wherein said silver halide emulsion layer includes at least about 50 mol% silver bromide.

14. The silver halide photographic material as claimed in claim 6, wherein said internal latent image silver halide photographic emulsion layer is a core/shell emulsion.

15. The silver halide photographic material as claimed in claim 1, wherein the 5- or 6-membered heterocyclic ring is substituted with at least one substituent.

16. The silver halide photographic material as claimed in claim 1, wherein $R^1$ or $R^2$ is substituted with at least one substituent.

* * * * *